US005988025A

United States Patent [19]

Sasaki et al.

[11] Patent Number: 5,988,025

[45] Date of Patent: Nov. 23, 1999

[54] SCREW FEEDING DEVICE IN CONTINUOUS SCREW DRIVING TOOL

[75] Inventors: Katsuhiko Sasaki; Kazunori Tsuge; Tomohiro Ukai, all of Anjo, Japan

[73] Assignee: Makita Corporation, Anjo, Japan

[21] Appl. No.: 08/900,934

[22] Filed: Jul. 25, 1997

[30] Foreign Application Priority Data

Jul. 26, 1996 [JP] Japan ..... 8-197730
Feb. 28, 1997 [JP] Japan ..... 9-046023

[51] Int. Cl.[6] ..... B25B 23/06

[52] U.S. Cl. ..... 81/434; 81/57.37

[58] Field of Search ..... 81/434, 57.37, 81/433

[56] References Cited

U.S. PATENT DOCUMENTS

| | | | |
|---|---|---|---|
| 4,059,034 | 11/1977 | Hornung | 81/57.37 |
| 4,146,071 | 3/1979 | Muller et al. | 81/434 |
| 4,428,261 | 1/1984 | Takatsu et al. | 81/434 |
| 5,083,483 | 1/1992 | Takagi . | |
| 5,687,624 | 11/1997 | Tsuge et al. | 81/57.37 |

FOREIGN PATENT DOCUMENTS

| | | |
|---|---|---|
| 0749808 | 12/1996 | European Pat. Off. . |
| 2641828 | 3/1978 | Germany . |
| 4119925 | 1/1992 | Germany . |
| 4208715 | 9/1992 | Germany . |
| 19526543 | 1/1996 | Germany . |
| 4208715 | 3/1996 | Germany . |
| 19606110 | 8/1996 | Germany . |
| 6114751 | 4/1994 | Japan . |
| 8216043 | 8/1996 | Japan . |

*Primary Examiner*—David A. Scherbel
*Assistant Examiner*—Lee Wilson
*Attorney, Agent, or Firm*—Dennison, Meserole, Scheiner & Schultz

[57] ABSTRACT

A screw feeding device in a continuous screw driving tool includes a casing mounted on a tool body of the continuous screw driving tool. A feeder box is reciprocally movable within the casing, so that a screw carrying belt is fed by a distance corresponding to one pitch of screws carried thereon as the feeder box is reciprocally moved by one stroke. A stopper base is mounted on the feeder box, and a mounting mechanism is provided for mounting the stopper base on the feeder box, so that the stopper base can be changed in its position relative to the feeder box. The mounting mechanism includes a plurality of lock holes and a lock member. The lock holes are formed on one of the stopper base and the feeder box and spaced from each other by a predetermined distance in a driving direction of a screw. The lock member has a lock protrusion engageable with any of the lock holes and is held in position in the screw driving direction relative to the other of the stopper base and the feeder box.

15 Claims, 23 Drawing Sheets

SCREW FEEDING DEVICE IN CONTINUOUS SCREW DRIVING TOOL

BACKGROUND OF THE INVENTION

1. Field of the Invention

The present invention relates to a screw feeding device in a 8 continuous screw driving tool and particularly to a screw feeding device having a stopper base which is adapted to be mounted on a feeder box for abutment on a work into which a screw is to be driven.

2. Description of the Prior Art

The conventional continuous screw driving tool has a screw feeding device for feeding a screw carrying belt by a distance corresponding to one pitch of screws carried thereon. The screw feeding device includes a feeder box and a stopper base which is mounted on the feeder box to cope with various types of screws having different lengths.

Japanese Laid-Open Patent Publication No. 6-114751 discloses a plurality of stopper bases having different lengths with respect to a driving direction of a screw. The stopper bases can be selectively mounted on a feeder box of a screw feeding device without using any tool, so that the stopper bases are exchangeable to each other to cope with various types of screws having different lengths.

However, with the conventional exchangeable stopper bases, the stopper bases other than that used for driving the screw are liable to be lost. To this end, this publication has proposed another embodiment in which a stopper base is mounted on the lower end of the feeder box such that the mounting position of the stopper base is adjustable. With this construction, one stopper base can be used for driving various types of screws having different lengths by adjusting the position of the stopper base. However, this construction still involves the problem that a tool is required for tightening and loosening a fixing screw which is used for fixing the stopper base in position relative to the feeder box.

Thus, the conventional stopper base is improved to some extent but still involves the problem in its handling

SUMMARY OF THE INVENTION

It is, accordingly, an object of the present invention to provide a screw feeding device in a continuous screw driving tool having a mounting mechanism which is operable to mount a stopper base on a feeder box at different positions to cope with various types of screws without using any tool.

According to the present invention, there is provided a screw feeding device in a continuous screw driving tool, comprising:

a casing mounted on a tool body of the continuous screw driving tool;

a feeder box reciprocally movable within the casing, so that a screw carrying belt is fed by a one pitch distance corresponding to the separation of screws carried thereon as the feeder box is reciprocally moved by one stroke;

a stopper base mounted on the feeder box; and a mounting mechanism for mounting the stopper base on the feeder box, so that the stopper base can be changed in its position relative to the feeder box, the mounting mechanism including:

a plurality of lock holes formed on one of the stopper base and the feeder box and spaced from each other by a predetermined distance in a driving direction of a screw; and a lock member having a lock protrusion engageable with any of the lock holes and held in position in the screw driving direction relative to the other of the stopper base and the feeder box.

With this construction, the stopper base can cope with various lengths of screws by changing the position of the stopper base in the driving direction. Therefore, it is not necessary to change the stopper base as adapted to another stopper base. In addition, the stopper base can be moved to and fixed in the desired position by removing the lock protrusion of the lock member from the lock hole as inserted, by moving stopper base to the desired position, and by inserting the lock protrusion into the corresponding lock hole. Therefore, in order to change the position of the stopper base relative to the feeder box, it is not necessary to tighten and release a fixing screw as required in the conventional device.

Since the stopper base is not required to be changed to another one, there will be no possibility of losing the stopper base. In addition, since it is not necessary to use any tool when the position of the stopper base requires to be changed, the position adjusting operation can be easily performed at any time and at any place to cope with the screw to be driven, so that the screw feeding device is excellent in its operability.

In a preferred embodiment, the lock member is movable in a direction to engage any of the lock holes and in a direction opposite thereto, and the mounting mechanism further includes biasing member for normally biasing the lock member in the engaging direction.

The lock holes may be formed in the stopper base, and the feeder box may include a recess for receiving the lock member, so that the lock member is slidably movable within the recess in a direction perpendicular to the driving direction of the screw.

The stopper base may be slidably movable along an outer wall of the feeder box and may include a wall part having the lock holes formed therein. The recess formed on the feeder box may extend in a direction perpendicular to a longitudinal direction of the wall part. In such a case, the lock protrusion of the lock member is positioned to confront the wall part.

Preferably, the feeder box has a substantially rectangular configuration in section and includes a first pair of confronting side walls and a second pair of confronting side walls. The stopper base includes a pair of vertical members slidably movable along the first pair of confronting side walls of the feeder box, and each of the vertical walls includes a pair of retainer walls formed on both sides thereof and is bent substantially perpendicular to corresponding vertical wall along a corresponding corner portion of the feeder box. At least one of the retainer walls comprises the wall part having the lock holes.

The lock member may includes a part positioned between the wall part and one of the second pair of confronting outer walls of the feeder box. This part extends outwardly beyond the wall part and serves as an operation part for operation by an operator from the outside.

The recess may be formed in the at least one of the first pair of confronting side walls of the feeder box, and the lock member may have a horizontal part received within the recess and positioned between the at least one of the first pair of confronting side walls and the vertical member of the stopper base facing thereto.

The lock member may have a horizontal part and a transverse part. The horizontal part is slidably received within the recess and has one end formed with the lock protrusion. The transverse part is bent substantially perpendicular to the horizontal part and extends along corresponding one of the second pair of confronting side walls. In this construction, the transverse part may comprises the part having the operation part.

Two of the retainer walls of the stopper base positioned on the side of one of the second pair of the side walls of the feeder box may comprise the wall parts having the lock holes. In such a case, the lock member includes a pair of the horizontal parts and one transverse part connecting the horizontal parts to each other.

The biasing member for biasing the lock member may be a spring interposed between the transverse member and one of the second pair of the side walls wall the feeder box.

The screw feeding device may further include a display device for displaying screw lengths suited to adjustable positions of the stopper base relative to the feeder box. The display device is operable to vary the displayed screw length in response to change in position of the stopper base.

Preferably, the displaying device may include a display member and a cursor. The display member is movable with the feeder box relative to the feeder box and has scale marks with numerals showing screw lengths. The cursor may be formed by a part of the casing.

The display member is positioned within the casing and extends downwardly from a lower end of the casing along an inner wall of the casing. The lower end of the casing may comprises the cursor.

It is further preferable that the display member serves to limit an upper stroke end of the feeder box relative to the casing and is detachably mounted on the feeder box.

The invention will become more fully apparent from the claims and the description as it proceeds in connection with the drawings.

DETAILED DESCRIPTION OF THE PREFERRED EMBODIMENTS

A first embodiment of the present invention will now be described with reference to FIGS. 1 to 16.

Figure 1:
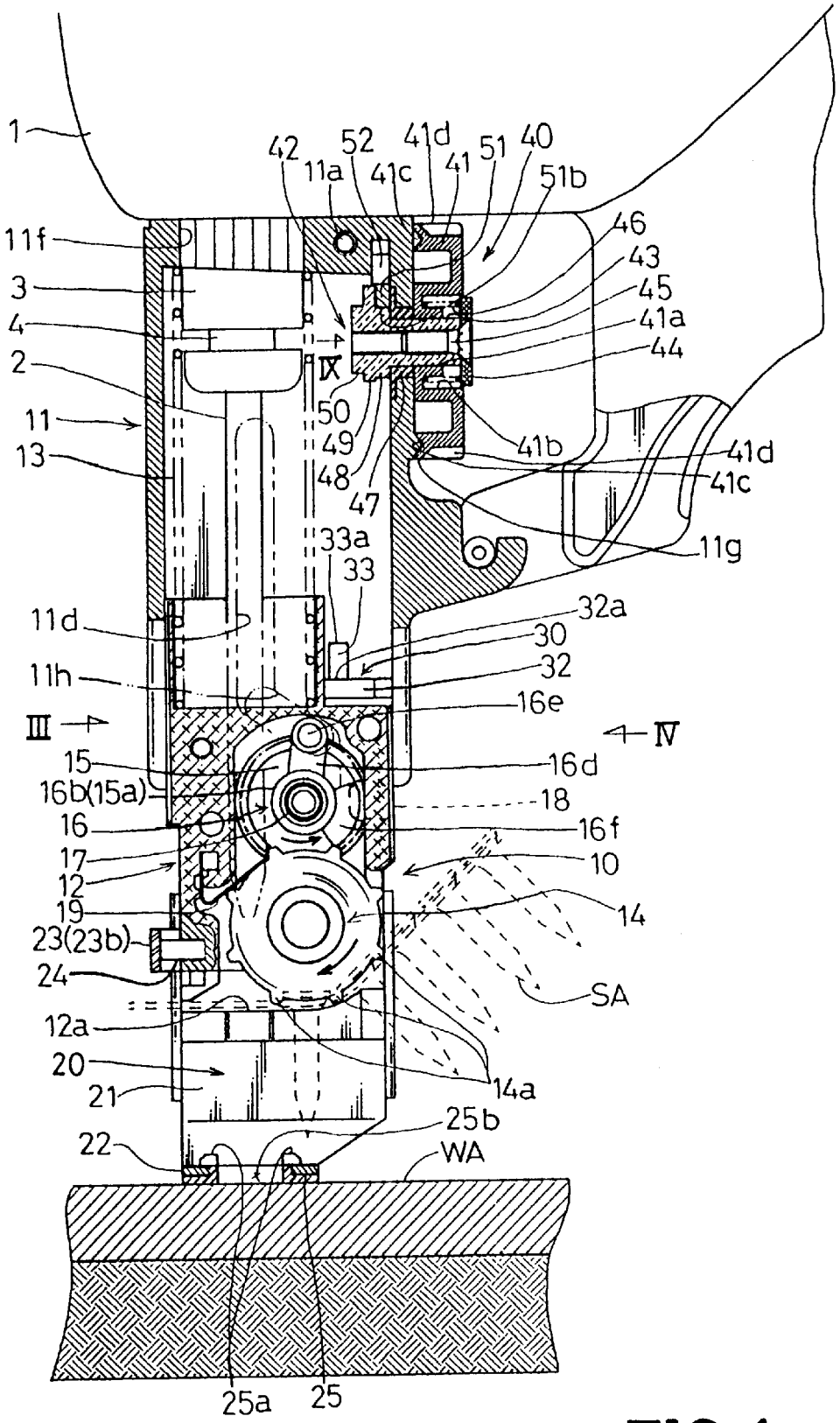
FIG. 1 is a vertical sectional view of a screw feeding device in a continuous screw driving tool according to a first embodiment of the present invention.

A screw feeding device 10 of this embodiment is shown in FIG. 1 and is provided on a lower portion of a tool body 1 of a continues screw driving tool. FIG. 1 shows only the lower portion of the tool body 1. The construction of the tool body 1 is the same as that of the conventional tool, and therefore, the tool body 1 will be described in brief. A spindle 4 extends downwardly from the tool body 1 and is rotatably driven by a motor (not shown) accommodated within the tool body 1. The spindle 4 is rotatably supported by a cylindrical bearing 3. A driver bit 2 is inserted into a lower end of the spindle 4 and is rotatable therewith on the same axis.

The screw feeding device 10 includes a tubular casing 11 having a substantially rectangular configuration in section. The casing 11 is split into two halves each having a mounting hole half 11*f* formed in an upper end plate for receiving the cylindrical bearing 3. The casing 11 is secured to the bearing 3 by tightening a fixing screw (not shown) which is in engagement with threaded holes 11*a* (only one shown in the drawings) formed in the split halves of the casing 11, so that the casing 11 is held in a position to extend downwardly from the tool body 1. The driver bit 2 extends through the casing 11 thus mounted on the tool body 1.

Figure 3:
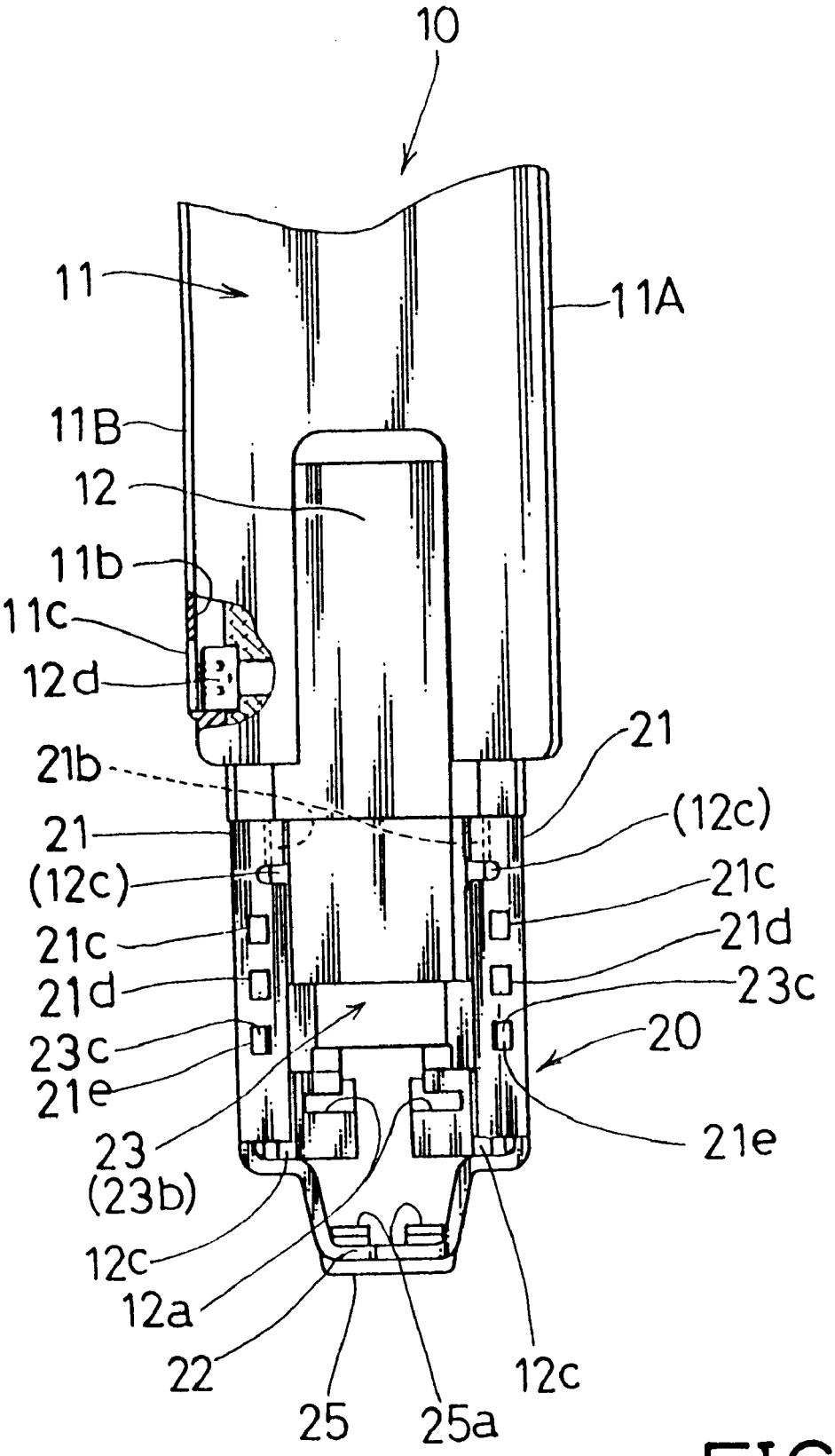
FIG. 3 is a view in a direction of arrow III in FIG. 1 and showing a front view of the lower portion of the casing, a feeder box and the stopper base.
Figure 4:
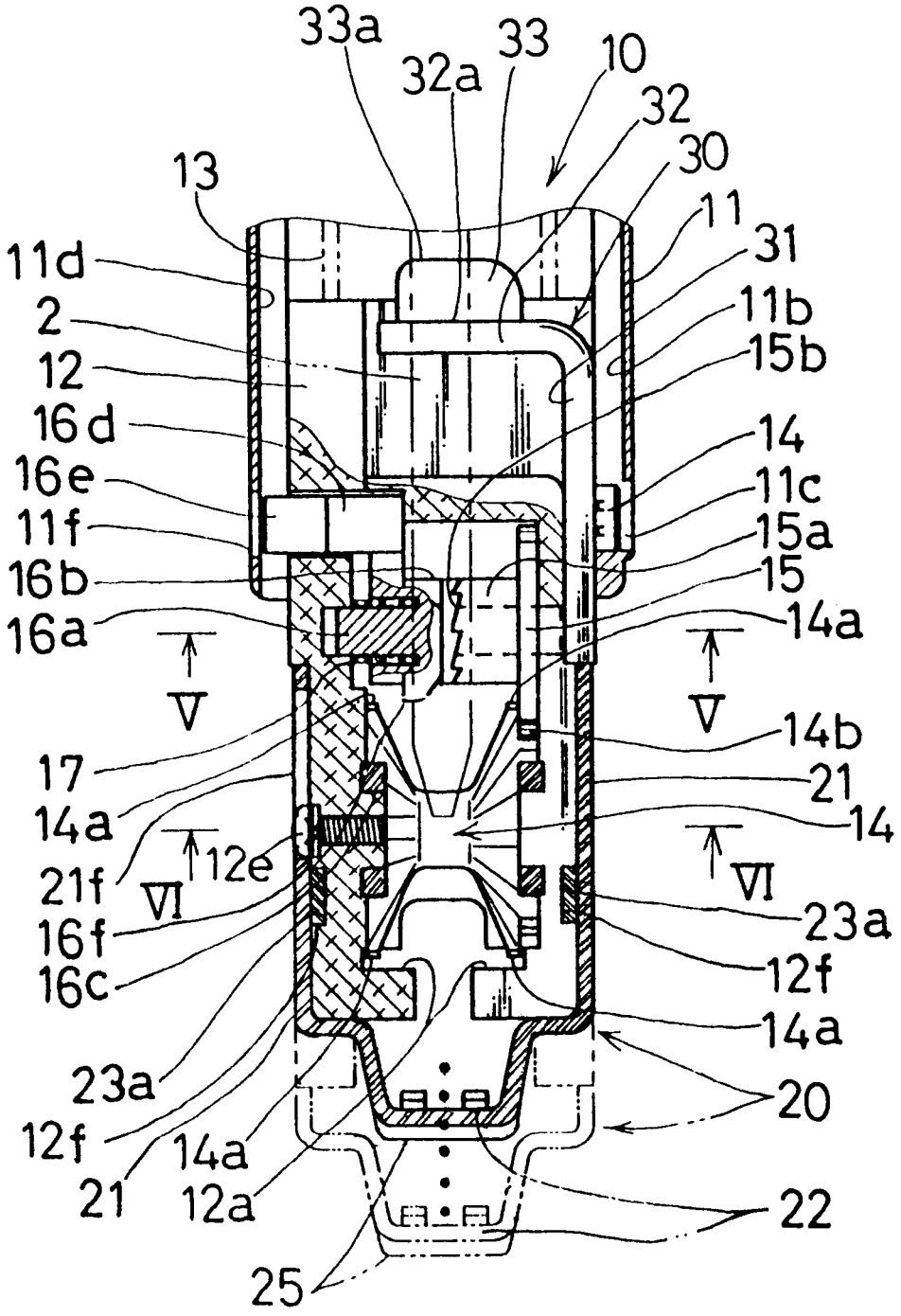
FIG. 4 is a vertical sectional view as viewed in a direction of arrow IV in FIG. 1.

A feeder box 12 is mounted within the casing 11 so as to be vertically reciprocally moved therewithin. The feeder box 12 is normally biased in a downward direction by a compression spring 13. The driver bit 2 extends through the feeder box 12 and protrudes downwardly from the lower end of the feeder box 12. As shown in FIGS. 3 and 4, a bolt 12*d* is in engagement with one lateral surface of the feeder box 12 and has a head positioned within a guide recess 11*b* which is formed in an inner surface of one lateral wall 11B of the casing 11. The guide recess 11*b* has a lower end, so that the head of the bolt 12*d* defines a lower stroke end of the feeder box 12 through abutment on the lower end of the guide recess 11*b*. The lateral wall 11B has a through hole 11*c* formed therein in communication with the guide recess 11*b* adjacent its lower end, so that the bolt 12*d* can be tightened and loosened by inserting an appropriate tool such as a screwdriver into the through hole 11*c*. When the bolt 12*d* has been loosened to be removed from the feeder box 12, the feeder box 12 can be removed from the casing 11. A mechanism for determining the upper stroke end of the feeder box 12 will be explained later.

The feeder box 12 has a substantially bifurcated configuration and has a pair of guide bases 12*a* formed on its lower portion. The guide bases 12*a* confront each other and serve to provide a guide for a screw carrying belt S. A ratchet wheel 14 is rotatably supported on the feeder box 12 in a position above the guide bases 12*a*. As will be seen from FIGS. 4 and 6, the ratchet wheel 14 has a configuration like a Japanese hand drum and has both ends each formed with a plurality of feeding claws 14*a* spaced from each other by a predetermined distance in a circumferential direction. The screw carrying belt S has two parallel rows of a series of engaging holes formed on both sides thereof. The engaging holes in each row are spaced one pitch from each other by the same distance as the feeding claws 14*a*. The ratchet wheel 14 is intermittently rotated by a predetermined angle in a direction indicated by an arrow in FIG. 1 or a clockwise direction with the feeding claws 14*a* on both ends of the ratchet wheel 14 engaged with the engaging holes of the screw carrying belt S, so that the screw carrying belt S is moved leftwardly as viewed in FIG. 1 by a distance corresponding to one pitch of the screws carried thereon.

Figure 5:
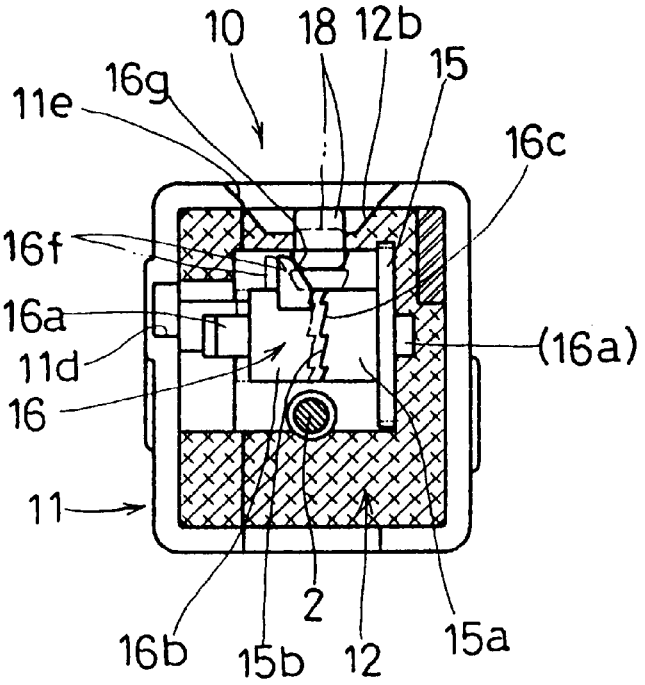
FIG. 5 is a sectional view taken along line V—V in FIG. 4.

As shown in FIG. 4, one end of the ratchet wheel 14 has a gear part 14*b* formed thereon. An intermediate gear 15 is in engagement with the gear part 14*b* and is rotatably supported on a support shaft 16*a* of a ratchet arm 16. As shown in FIG. 5, the ratchet arm 16 is pivotally movable about the axis of the support shaft 16*a* and is slidably movable with the support shaft 16*a* in an axial direction (right and left directions as viewed in FIGS. 4 and 5). The support shaft 16*a* is supported on the feeder box 12 and extends between the bifurcated parts of the feeder box 12. A cylindrical portion 16*b* is formed on substantially the central portion of the support shaft 6*a* in its longitudinal direction. Saw teeth-like engaging claws 16*c* are formed on one end of the cylindrical portion 16*b* and are spaced from each other in a circumferential direction by a predetermined distance.

A cylindrical portion 15*a* is formed on the intermediate gear 15 and confronts the cylindrical portion 16*b* of the ratchet arm 16. The cylindrical portion 15*a* has saw teeth-like engaging claws 15*b* formed on its one end for engagement with the engaging claws 16*c*, so that the engaging claws 15*b* and 16*c* cooperate to form a one-way clutch. When the ratchet arm 16 is pivoted by a predetermined angle in a feeding direction with the engaging claws 15*b* and 16*c* engaged with each other, the intermediate gear 15 is rotated in the direction in a counterclockwise direction as indicated by an arrow in FIG. 1, so that the ratchet wheel 14 is rotated to move the screw carrying belt S by the distance corresponding one pitch of the screws.

A compression spring 17 is interposed between the cylindrical portion 16*b* on the side of the ratchet arm 16 and the feeder box 12, so that the ratchet arm 16 is normally biased in a right direction as viewed in FIG. 4. Thus, the engaging claws 16*c* on the side of the ratchet arm 16 is forced to be pressed on the engaging claws 15*b* on the side of the intermediate gear 15, so that the engaging claws 16*c* and 15*b* are normally held in engagement with each other.

When the ratchet arm 16 is pivoted in a direction opposite to the feeding direction (a clockwise direction as viewed in FIG. 1), the ratchet arm 16 is moved leftwardly as viewed in FIG. 4 against the biasing force of the compression spring 17, so that the engaging claws 16*c* and 15*b* are disengaged from each other. As the engaging claws 16*c* and 15*b* are thus disengaged, the ratchet arm 16 is pivoted relative to the intermediate gear 15 in the direction opposite to the screw feeding direction by an angle corresponding to one pitch of the screws.

A substantially L-shaped support leg 16*d* extends laterally from the lateral surface of the cylindrical portion 16*b* of the ratchet arm 16 and has one end on which a guide roller 16*e* is rotatably mounted. The guide roller 16*e* is in engagement with a guide slot 11*d* formed in the inner surface of the casing 11. An arcuate slot 12*h* is formed in the feeder box 12, so that the guide roller 16*e* is moved within the arcuate slot 12*h* as the ratchet arm 16 is pivotally moved as will be hereinafter explained.

Figure 2:
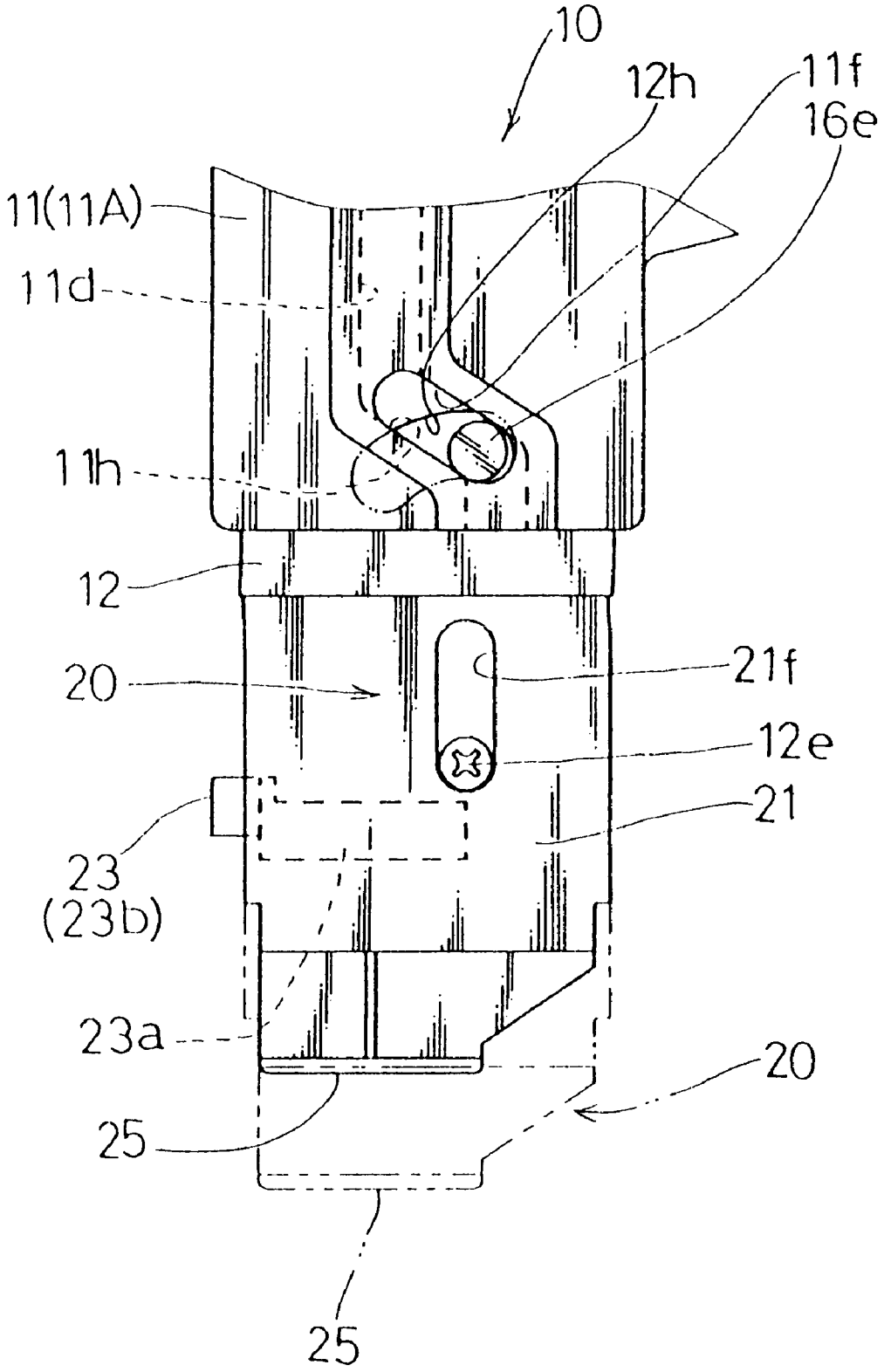
FIG. 2 is a side view of the screw feeding device and showing a lower portion of a casing and a stopper base.

As shown in FIG. 2, the guide recess 11*d* includes a slant portion 11*h* in a position adjacent its lower end. As the feeder box 12 is reciprocally moved relative to the base 11, the guide roller 16*e* is reciprocally moved along the slant portion 11*h*, so that the ratchet arm 16 is forced to be pivoted alternately in the feeding direction and the direction opposite thereto by the predetermined angle. When the feeder box 12 is moved upwardly relative to the casing 11, the guide roller 16*e* is moved leftwardly as viewed in FIG. 2, so that the ratchet arm 16 is pivoted in the feeding direction.

In contrast, when the feeder box 12 is moved downwardly relative to the casing 11, the guide roller 16*e* is moved rightwardly as viewed in FIG. 2, so that the ratchet arm 16 is pivoted in the direction opposite to the feeding direction. In this case, however, since the engaging claws 16*c* and 15*b* are disengaged from each other by the movement of the ratchet arm 16 in the axial direction against the biasing forth of the spring 17, the intermediate gear 15 as well as the ratchet wheel 14 is not rotated but is held in a position which was taken when the screw carrying belt S has been moved by the distance of one pitch of the screws.

As shown in FIG. 2, an elongated hole-like window 11*f* is formed in the casing 11 along the slant portion 11*h* of the guide recess 11*d*. The lower end of the guide recess 11*d* is open at the lower end of the casing 11, so that the guide roller 16*e* can be easily inserted into the guide slot during an assembling operation.

As shown in FIG. 5, a releasing portion 16*f* is formed on the lateral surface of the cylindrical portion 16*b* of the ratchet arm 16. The releasing portion 16*f* has an inclined surface 16*g* inclined outwardly leftwardly as viewed in FIG. 5. A releasing button 18 is mounted on the feeder box 12 and is movable in and out from the feeder box. The releasing button 18 has a head which is in abutment on the inclined surface 16*g*. Since the ratchet arm 16 is biased by the compression spring 17 in a direction for engagement of the engaging claws 16*c* with the engaging claws 15*b* of the intermediate gear 15, the head of the releasing button 18 is normally held in abutment on the inclined surface 16*g*. In addition, the biasing force of the compression spring 17 as applied forces the releasing button 18 in a direction outwardly of the feeder box 12 (upwardly as viewed in FIG. 5).

As shown in FIG. 1, the releasing portion 16*f* has a fan-like configuration extending in the circumferential direction of the cylindrical portion 16*b*. The circumferential length of the releasing portion 16*f* is determined to be at least the possible pivotal angle of the ratchet arm 16, so that the head of the releasing button 18 is always held in abutment on the inclined surface 16*g* of the releasing portion 16*f* irrespective of the pivotal movement of the ratchet arm 16.

The head of the releasing button 18 has a conical lateral surface having an inclination angle corresponding to the inclination of the inclined surface 16*g*, so that the movement of the releasing portion 16*f* in the axial direction can be effectively converted into the movement of the releasing button 18 in the direction perpendicular to the moving direction of the releasing portion 16*f*. In addition, the head of the releasing button 18 has an outwardly expanding flange-like configuration, so that the releasing button 18 is prevented from being removed from the feeder box 12 irrespective of the biasing force applied from the releasing portion 16*f*.

A cut-out slot 11*e* and a concave portion 12*b* having a through hole for receiving the releasing button 18 are formed in the casing 11 and the feeder box 12, respectively, so that an operator can access the releasing button 18 for pushing the same from the outside. Here, the releasing button 18 may not extend from an outer surface of the casing 11 when the releasing button 18 is not pushed into the casing 11.

With this construction, the releasing button 18 is normally held in a position protruding into the concave portion 12*b* and the cutout slot 11*e* as indicated by solid lines in FIG. 5. When the operator pushes the releasing button 18, the releasing button 18 is retracted to a position indicated by chain lines in FIG. 5, resulting in that the ratchet arm 16 is moved leftwardly against the biasing force of the spring 17 by the interaction between the head of the releasing button 18 and the inclined surface 16*g*, so that the engaging claws 16*c* are disengaged from the engaging claws 15*b*.

When the engaging claws 16*c* are disengaged from the engaging claws 15*b*, the ratchet arm 16 and the intermediate gear 15 are disconnected from each other in the rotational direction, so that the ratchet wheel 14 as well as the intermediate gear 15 is allowed to be rotated in a direction opposite to the direction for feeding the screw carrying belt S or the feeding direction. Therefore, the operator can draw out the screw carrying belt S from the screw feeding device 10 in a direction opposite to the direction for feeding the screw carrying belt S (right direction as viewed in FIG. 1).

As shown in FIG. 1, a leaf spring 19 has one end mounted on the feeder box 12 and is positioned adjacent the ratchet wheel 14. The leaf spring 19 has the other end or a fee end pressed on the circumferential surface of the ratchet wheel 14, so that the leaf spring 19 provides a resistance force against rotation of the ratchet wheel 14. Thus, in the feeding direction (the direction indicated by the arrow in FIG. 1), the ratchet wheel 14 is rotated against the pressure applied from the free end of the leaf spring 19 while the free end of the leaf spring 19 is resiliently bent outwardly of the ratchet wheel 14. With the resistance force applied from the leaf spring 19, the ratchet wheel 14 may not be excessively rotated but can be reliably stopped after it has been rotated by the predetermined angle.

The resistance force applied from the leaf spring 19 serves to eliminate backlash of the ratchet wheel 14 in the rotational direction. In addition, since the length of the leaf spring 19 is determined such that the proximal edge of the free end of the leaf spring 19 is brought to abut on one of the feeding claws 14*a* on the side opposite to the feeding direction after the ratchet wheel 14 has been rotated to feed the screw carrying belt S by the distance of one pitch of the screws. This may also prevent the ratchet wheel from rotating in the direction opposite to the feeding direction. Further, the rotation of the ratchet wheel in the direction opposite to the feeding direction may be also prevented by the intermediate gear 15 since the intermediate gear 15 is stopped after the screw carrying belt S has been fed by the distance of one pitch.

Figure 11:
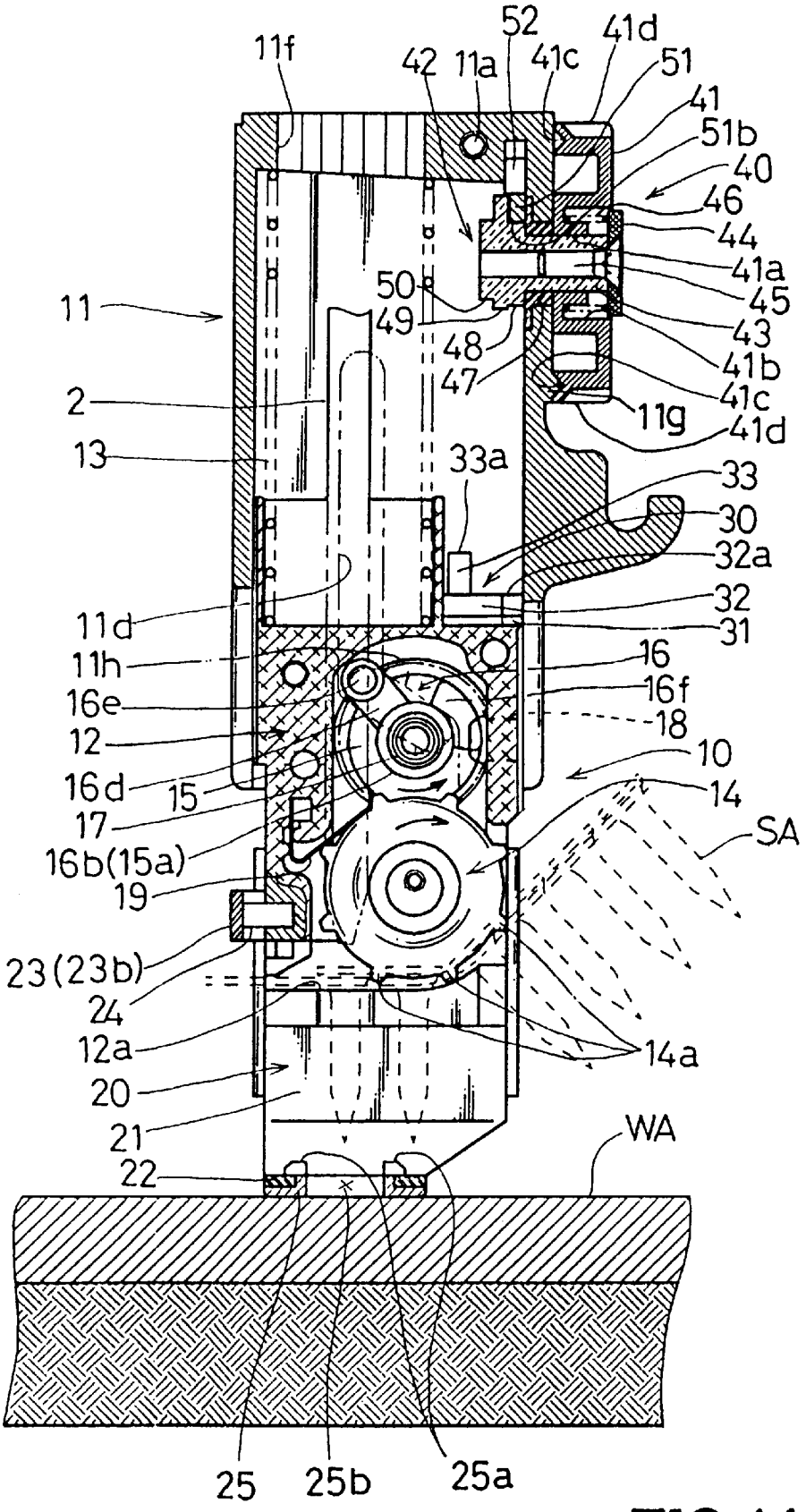
FIG. 11 is a vertical sectional view of the screw driving device showing the operation when a tool body is pressed downwardly to some extent and showing the operation adapted for driving an A-type screw with the stopper base positioned in the lower position and with the shifter pin positioned in the first position.
Figure 12:
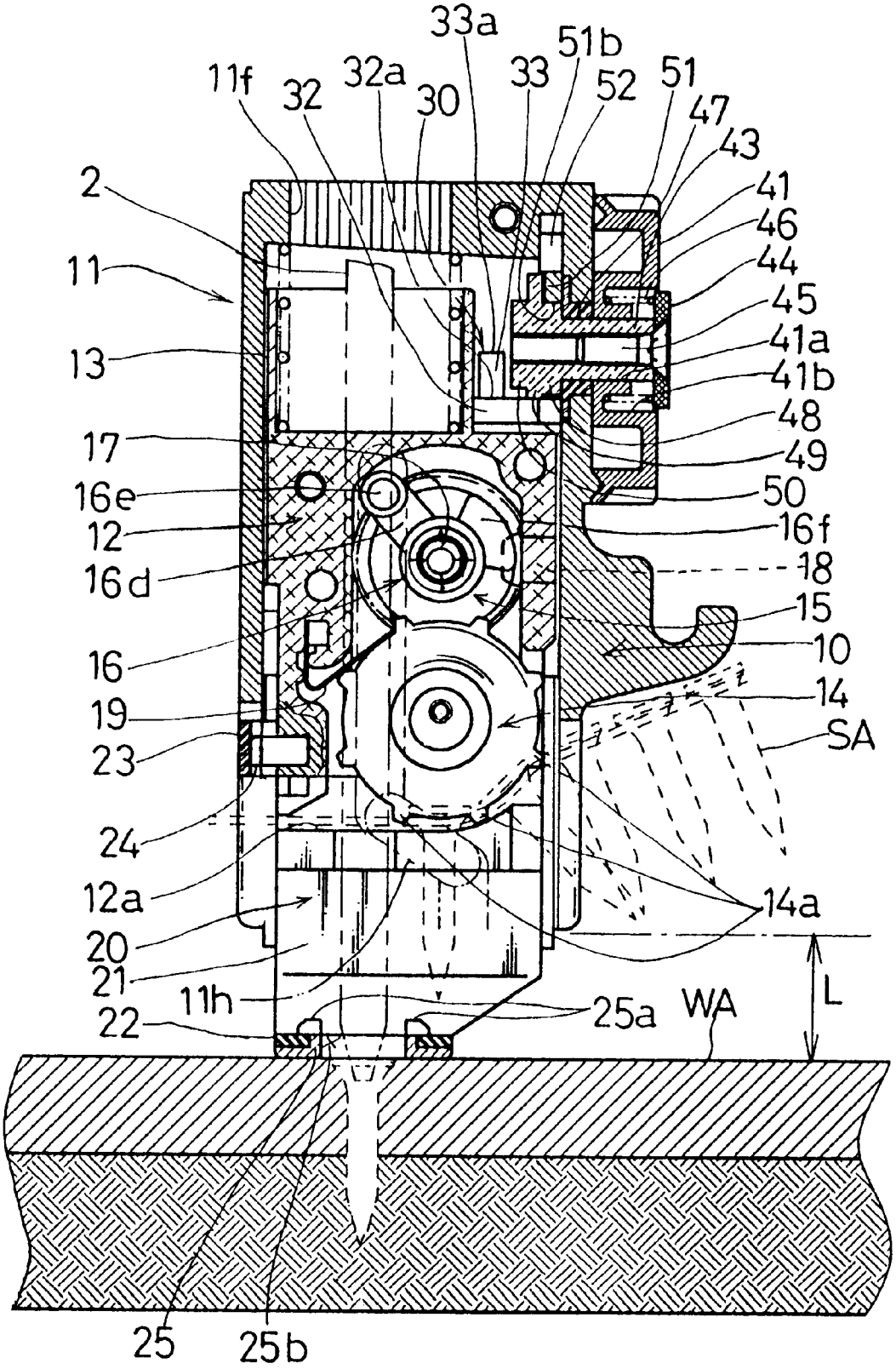
FIG. 12 is a view similar to FIG. 11 but showing the state where the tool body has been lowered to its lowermost position.
Figure 13:
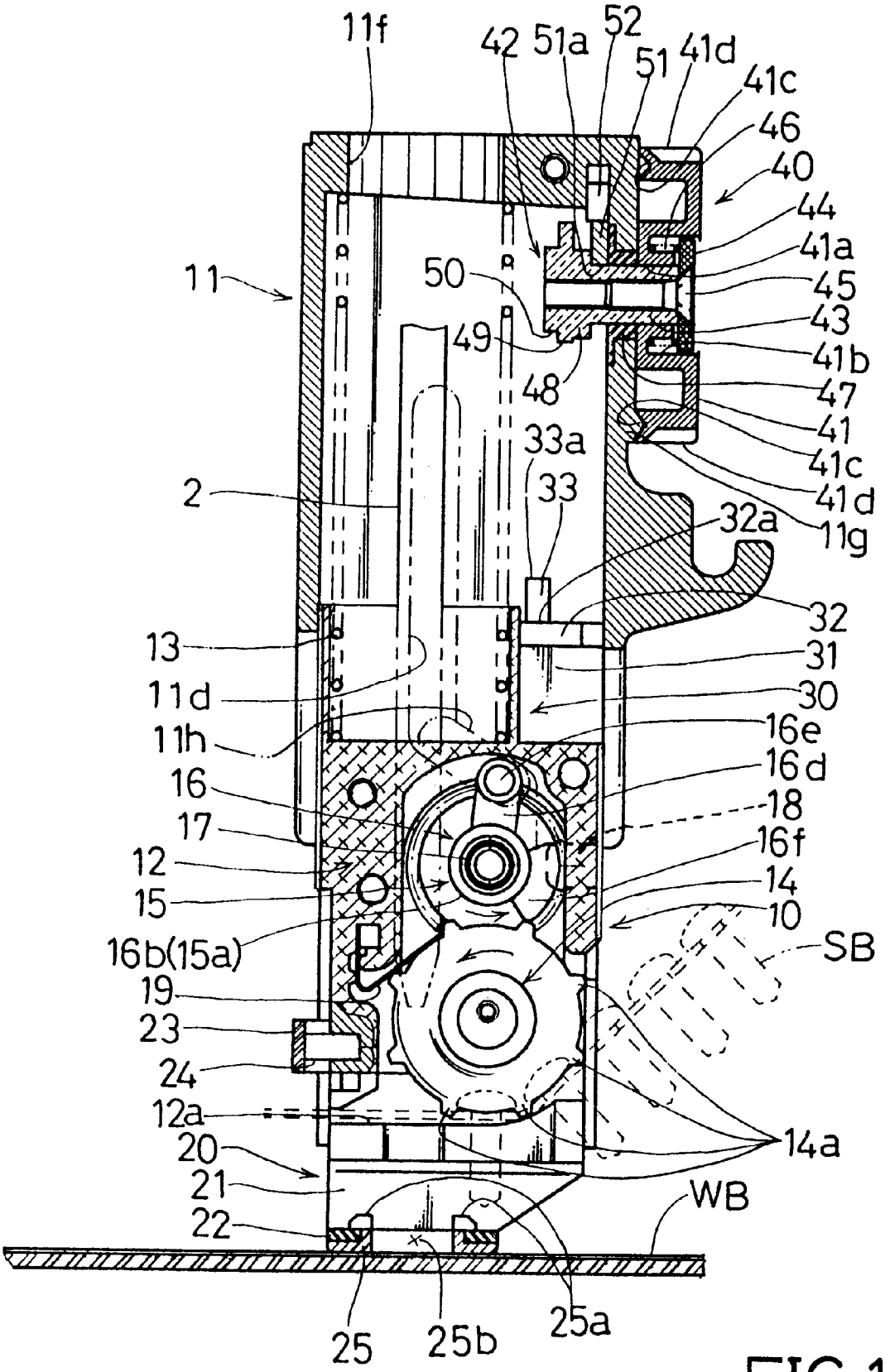
FIG. 13 is a vertical sectional view of the screw driving device showing the operation when the tool body is not pressed downwardly and the operation adapted for driving a B-type screw with the stopper base positioned in the uppermost position and with the shifter pin positioned in the second position.
Figure 14:
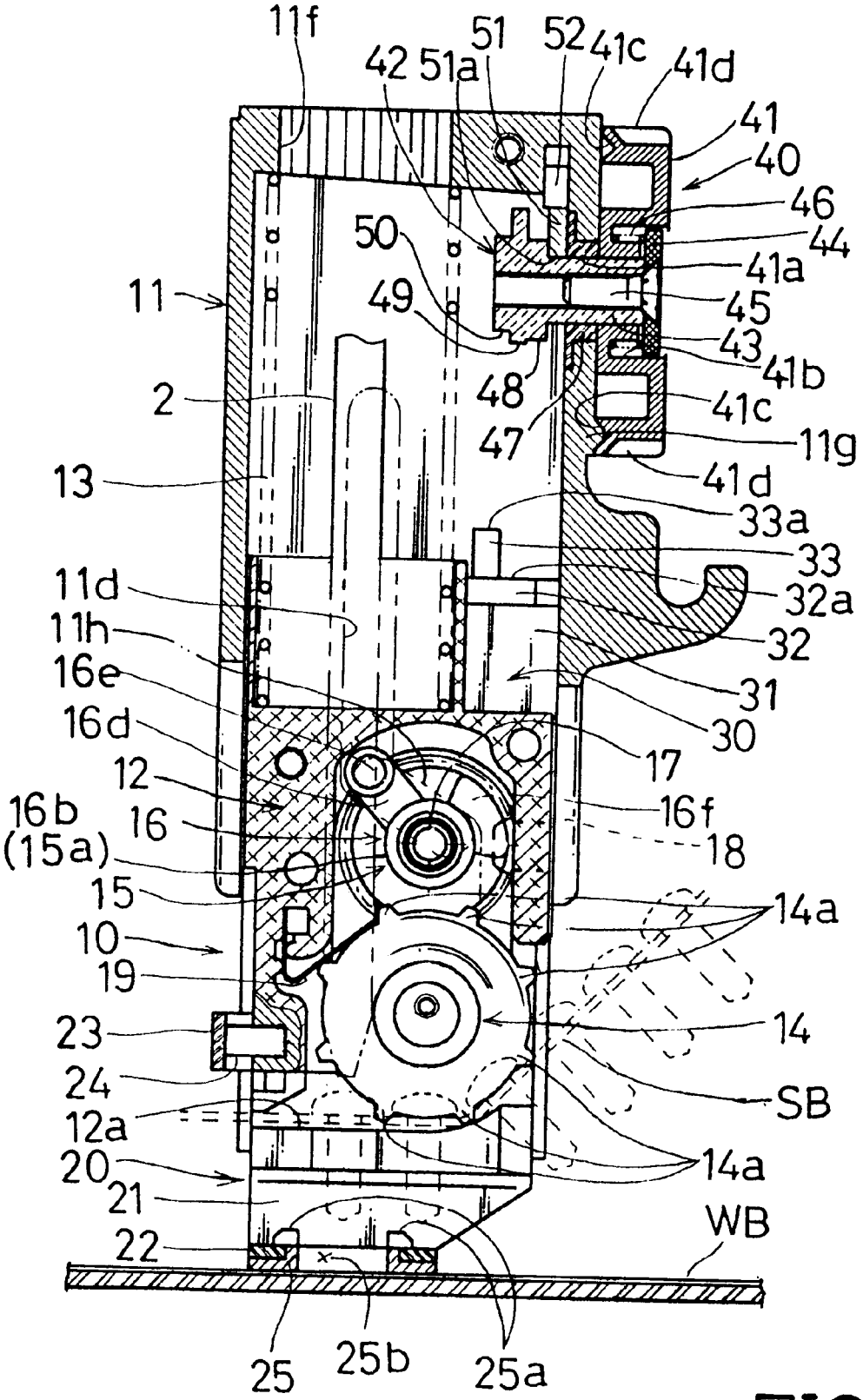
FIG. 14 is a view similar to FIG. 13 but showing the operation when the tool body has been pressed downwardly to some extent to pivot a ratchet arm by a predetermined angle.
Figure 15:
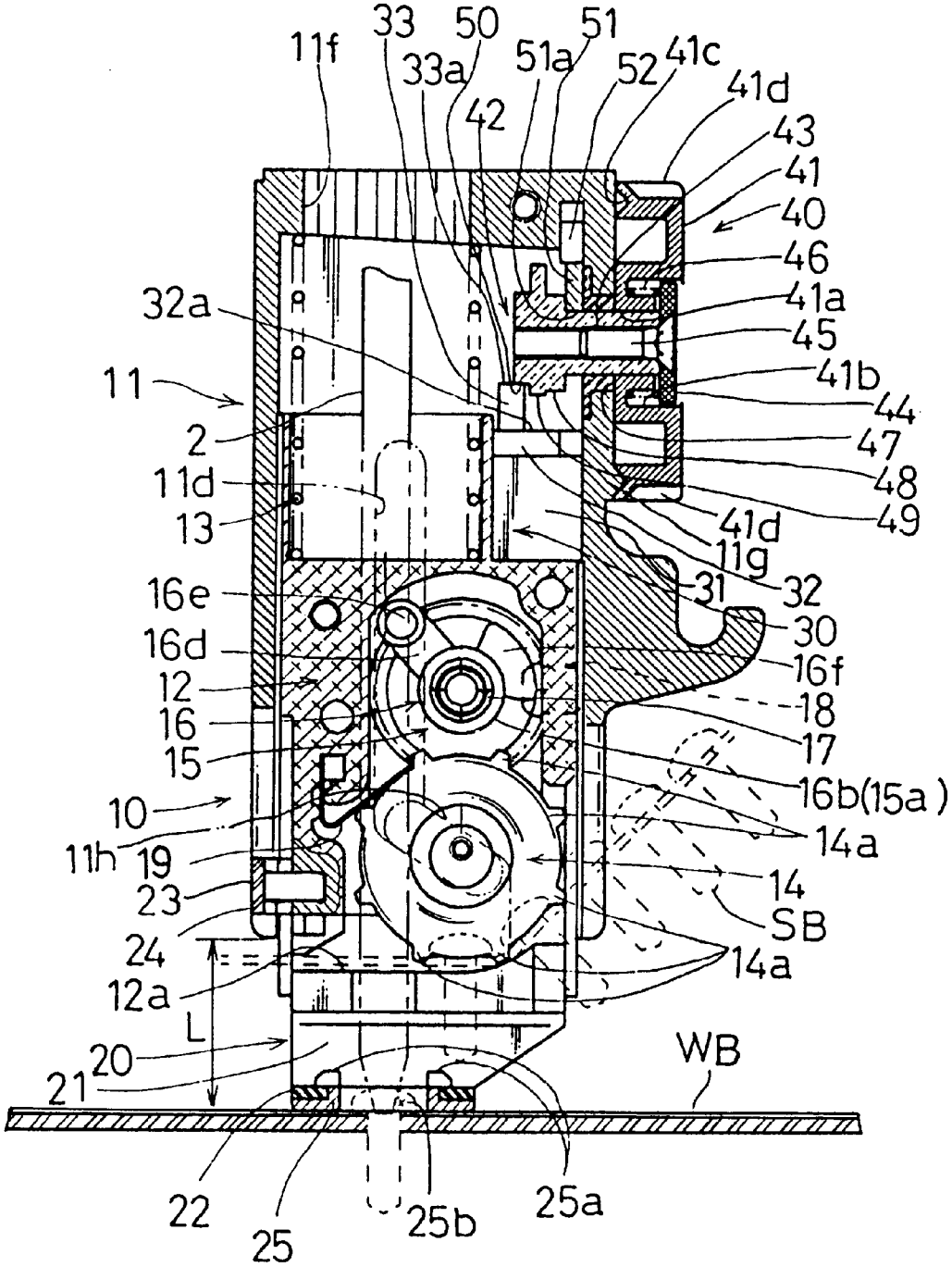
FIG. 15 is a view similar to FIG. 13 but showing the operation when the tool body has been pressed downwardly to its lowermost position to completely drive the screw.

The operation of the screw feeding device 10 will now be explained with reference to FIGS. 1 and 11 to 15. FIGS. 1, 11 and 12 show the operation when the screw feeding device 10 is applied to the screw carrying belt S carrying screws (hereinafter called "A-type screws") which are adapted to be driven into a work W(WA) until upper surfaces of their heads are positioned substantially flush with the upper surface of the work W(WA). FIGS. 13 to 15 show the operation when the screw feeding device 10 is applied to the screw carrying belt S carrying screws (hereinafter called "B-type screws SB") which are adapted to be driven into a work W(WB) until lower surfaces of their heads abut on the upper surface of the work W(WB). The operations of the screw feeding device 10 for feeding the screw carrying belt S carrying the A-type screws SA and that carrying the B-type screws SB are performed in the same manner. Therefore, the operation will be described only in connection with the feeding operation of the screw carrying belt S carrying the A-type screws SA with reference to FIGS. 1, 11 and 12.

In the drawings, the work WA and WB are adapted for driving the A-type screws SA and the B-type screws SB, respectively. A stopper base 20 is mounted on the feeder box 12, and a stopper mechanism 40 is provided for limiting the upper stroke end of the feeder box 12. The stopper base 20 and the stopper mechanism 40 will be explained later.

FIG. 1 shows the situation where the stopper base 20 is in abutment on the work WA without any pressing force applied thereto and where the screw feeding device 10 is in an inoperative position. In the inoperative position, the head of the bolt 12*b* is in abutment on the bottom of the guide recess 11*b* (see FIG. 3), so that the feeder box 12 is in its lower stroke end and that the guide roller 16*e* is positioned at the lower end of the slant portion 11*h* of the guide recess 11*d*.

When the operator presses the tool body 1 downwardly toward the work WA with the screw feeding device 10 in the inoperative position, the feeder box 12 is moved upwardly relative to and within the casing 11 against the biasing force of the compression spring 13 as shown in FIG. 11. As the feeder box 12 is moved upwardly, the guide roller 16*e* is moved leftwardly as viewed in FIG. 11 along the slant portion 11*h* of the guide recess 11*d,* so that the ratchet arm 16 is pivoted in the feeding direction as indicated by the arrow by the predetermined angle.

As the ratchet arm 16 is thus pivoted, the intermediate gear 15 is rotated by the same angle in the same direction through engagement between the engaging claws 15*b* and 16*c,* so that the ratchet wheel 14 is rotated in the feeding direction to feed the screw carrying belt S by the distance of one pitch of the screws SA. By such a movement of the screw carrying belt S, one of the screws SA is set to be positioned directly below the driver bit 2 as shown in FIG. 11.

As the operator further presses the tool body 1 downwardly, the feeder box 12 is further moved upwardly relative to the casing 11 and the lower end of the driver bit 2 is brought to abut on the head of the screw SA At this stage, the guide roller 16*e* has been moved from the slant portion 11*h* to a vertical linear portion of the guide recess 11*d,* so that the ratchet arm 16 may not be rotated and that the ratchet wheel 14 is held in a position which is taken when the screw carrying belt S has been moved by the distance of one pitch of the screws SA.

As the operator still further presses the tool body 1 with the driver bit 2 in abutment on the head of the screw SA, the driver bit 2 is started to be rotated and the screw SA is removed from the screw carrying belt S. At substantially the same time with the removal of the screw SA, the lower end of the screw SA is brought to abut on the work WA and the screw SA is then driven into the work WA. The situation where the screw SA has been completely driven into the work WA is shown in FIG. 12.

When the screw SA has been completely driven, a stroke converting member 30 provided on the feeder box 12 is brought to abut on a cam 49 (or a cam 50) of the stopper mechanism 40, so that the feeder box 12 reaches its upper stroke end. This means that the tool body 1 as well as the casing 11 reaches its lower stroke end. At this stage, the lower end of the casing 11 is spaced from the work WA by a distance L.

After completion of the screw driving operation, the operator releases the pressing force applied to the tool body 1, so that the feeder box 12 is moved downwardly relative to the casing 11. As the feeder box 12 is thus moved downwardly, the ratchet arm 16 is pivoted by the predetermined angle in the direction opposite to the feeding direction through the movement of the guide roller 16*e* along the slant portion 11*h* of the guide recess lid from the position shown in FIG. 11 to the position shown in FIG. 1. At this stage, however, the intermediate gear 15 is prevented from rotating in the direction opposite to the feeding direction by the leaf spring 19. Therefore, the ratchet arm 16 is moved axially against the biasing force of the compression spring 17 as it is pivoted in the direction opposite to the feeding direction, so that the engaging claws 16*c* and 15*b* are disengaged from each other, and that the ratchet arm 16 is pivoted in the direction opposite to the feeding direction or the reverse direction by the predetermined angle corresponding to one pitch of the screws SA. When the ratchet arm 16 has been thus pivoted in the reverse direction, the guide roller 16*e* is positioned at the lower end of the slant portion 11*h,* and the head 12*b* of the bolt 12*d* is in abutment on the bottom of the guide recess 11*b,* so that the feeder box 12 is in its lower stroke end. One cycle of the screw driving operation is thus completed.

With the screw feeding device 10 thus constructed, the distance L can be provided between the lower end of the casing 11 and the work WA when the casing 11 is in its lower stroke end after completion of the driving operation.

Figure 25:
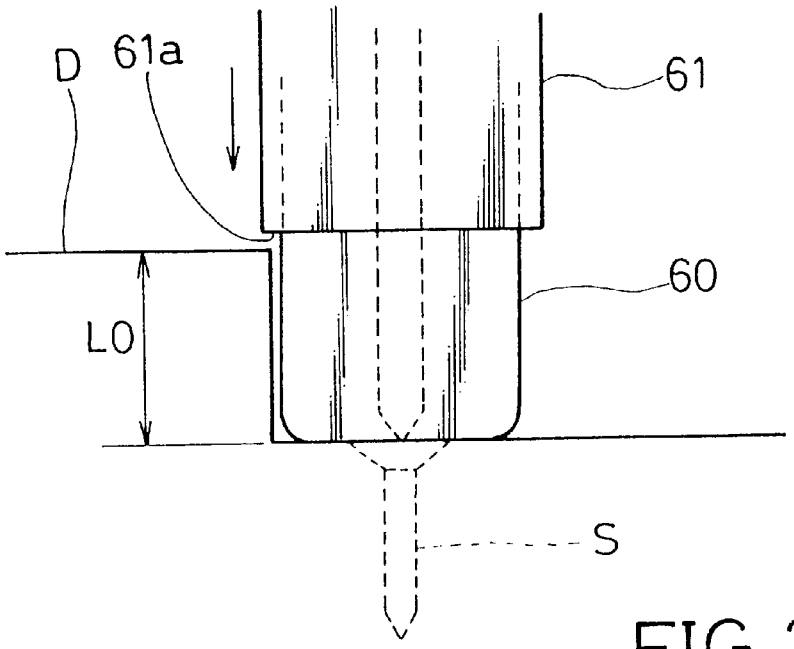
FIG. 25 PRIOR ART
FIG. 25 is a view showing the positional relationship between a stepped portion of a work and a lower end of a casing of the conventional screw driving device.

As shown in FIG. 25, when a conventional screw driving tool is adapted to drive a screw into a work such as a picture frame in a position adjacent a stopped portion D of the article, a lower end 61 of a casing 61 of the tool which slidably supports a feeder box 60 may abut on an upper surface of the stepped portion D as the casing 61 is lowered for driving the screw. This may cause a problem that the stopped portion D is damaged by the casing 61.

Figure 26:
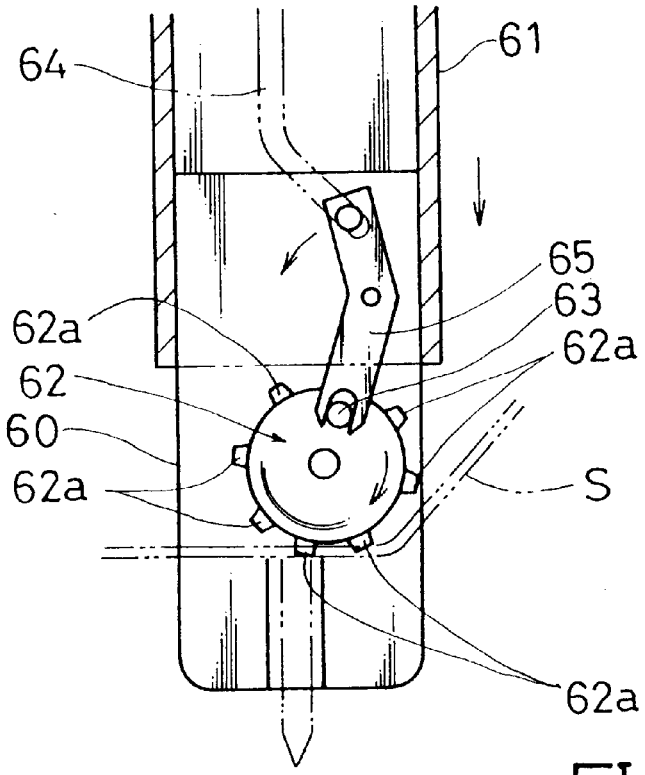
FIG. 26 PRIOR ART
FIG. 26 is a vertical sectional view of the essential parts of the conventional screw driving device.

For preventing the article from such a damage, Japanese Laid-Open Patent Publication Nos. 3-49879 and 4-111781 have proposed to determine an upper stroke end of the feeder box 60 such that the distance between the lower end 61*a* of the casing 61 and a lower end of the feeder box 60 is greater than a predetermined height L0 of the stepped portion D when the feeder box 60 is in its upper stroke end. Here, the height L0 is appropriately selected. In order to provide such a greater distance, a screw feeding device of the above publications has been constructed to include a feeding arm 65 which is pivotally mounted on the feeder box as shown in FIG. 26. The feeding arm 65 has one end engaged with a feeding pin 63 extending laterally from a ratchet wheel 62 and has the other end engaged with a guide slot 64 having a bent portion formed and formed in a lateral surface of the casing 61.

The ratchet wheel 62 is rotatably supported by the feeder box 60 and has a number of feeding claws 62*a* formed on its periphery. With the feeding claws 62*a* engaged with the screw carrying belt S, the ratchet wheel 62 is rotated in a direction indicated by an arrow in FIG. 26, so that the screw carrying belt is moved leftwardly by a distance corresponding to one pitch of the screws. Such rotation of the ratchet wheel 62 is produced by the movement of the casing 61 in the downward direction. Thus, as the casing 61 is moved downwardly for the screw driving operation, the feeding arm 65 is pivoted by a predetermined angle in a counterclockwise direction indicated by an arrow in FIG. 26 due to the movement of the other end of the feeding arm 65 along the guide slot 64, so that the feeding pin 63 in engagement with one end of the feeding arm 65 is forced to be moved in the feeding direction of the screw carrying belt S.

The feeding arm 65 interposed between the ratchet wheel 62 and the casing 61 serves to provide a remote control of the rotation of the ratchet wheel 62 to be caused by the downward movement of the casing 61, so that the lower stroke end of the casing 61 can be determined to prevent the stepped portion from being damaged while a sufficient stroke of movement of the feeder box 60 relative to the casing 61 can be ensured.

However, with the conventional screw feeding device, one end of the feeding arm 65 is always in engagement with the feeding pin 63 pivoted laterally of the ratchet wheel 62. Therefore, one end of the feeding arm 65 as well as the feeding pin 63 tens to be soon worn, so that the conventional screw feeding device still involves the problem that it has less durability.

With this embodiment, the distance L is determined to be greater than the height L0 of the stepped portion D (see FIG.

25), so that the casing 11 may not abut on the stepped portion D or may not cause damage thereto even if the screw SA is to be driven into the work in a position adjacent the stepped portion D.

In addition, with this embodiment, the intermediate gear 15 is interposed between the ratchet arm 16 and the ratchet wheel 14, and by means of the intermediate gear 15, the ratchet wheel 14 is rotated by the predetermined angle in the feeding direction to feed the screw carrying belt S by the distance of one pitch of the screws SA. Therefore, this embodiment does not require any member corresponding to the feeding pin 63 (see FIG. 26) provided in the conventional screw feeding device. As described above, in the conventional device, the wear produced during transmission of rotation is concentrated upon one feeding pin 63 since this pin 63 is always in engagement with one end of the feeding arm 65. Therefore, one end of the feeding arm 65 as well as the feeding pin 63 may be easily worn, resulting in that the durability of the feeding device is remarkably degraded.

In contrast, with the screw feeding device 10 of this embodiment, the pivotal movement of the ratchet arm 16 is transmitted to the ratchet wheel 14 through engagement of teeth of the intermediate gear 15 and teeth of the gear part 14*b* of the ratchet wheel 14. Therefore, any wear which may be produced during the transmission can be dispersed to all the teeth of the intermediate gear 15 and to all the teeth of the gear part 14*b* of the ratchet wheel 14. Therefore, the durability of the screw feeding device 10 may be significantly improved.

In addition, the intermediate gear 15 is positioned deeper into the feeder box 12 than the ratchet wheel 14, and the ratchet wheel 14 as well as the intermediate gear 15 is permitted to be rotated in the direction opposite to the feeding direction when the engagement of the ratchet arm 16 with the intermediate gear 15 is released. Therefore, the releasing portion 16*f* and the releasing button 18 for disengagement between the intermediate gear 15 and the ratchet arm 16 may be disposed as deep as possible into the feeder box 12.

In contrast, with the prior art arrangement as disclosed in Japanese Laid-Open Patent Publication Nos. 3-49879 and 4-111781, an engaging member is adapted to directly engage the ratchet wheel for preventing the ratchet wheel from rotating in a direction opposite to a feeding direction. The engaging member is operable to permit rotation of the ratchet wheel in the direction opposite to the feeding direction and to permit withdrawal of a screw carrying belt in the same direction. For this reason, an operation member such as a lever for operation of the engaging member is disposed in a position adjacent the ratchet wheel. The place about the ratchet wheel includes many parts which are exposed to the outside because of the construction and the function of the ratchet wheel. Therefore, dusts and foreign materials may easily enter the place about the ratchet wheel, and the prior arrangement involves the problem that the operation member for the engaging member may not be reliably operated.

With the above described embodiment of the present invention, the permission of rotation of the ratchet wheel 14 in the direction opposite to the feeding direction is not given by the operation of the engaging member which is directly engaged with the ratchet wheel as in the prior art. Thus, the rotation is permitted indirectly through disengagement between the ratchet arm 16 and the intermediate gear 15 which are disposed deeper into the feeder box 12 than the ratchet wheel 14. Therefore, the releasing portion 16*f* and the releasing button 18 can be disposed in a position which is deeper into the feeding box 12 than the ratchet wheel 14, so that the chance of entrance of dusts and foreign materials may be reduced, and that the releasing button 18 has less chance to cause unreliable operation. In other respect, as shown in FIG. 1, the stopper base 20 of the screw feeding device 10 of this embodiment is adapted to abut on the work W and is operable to convert the distance between the screw carrying belt S and the work W so as to cope with change of screws SA to those having different lengths.

The stopper base 20 is shown in FIGS. 7(A) to 7(D) and has a substantial U-shaped configuration including a pair of vertical members 21 and a transverse member 22 connected between the lower ends of the vertical members 21. The stopper base 20 is mounted on the feeder box 12 such that the stopper base 20 extends between both bifurcated lower portions of the feeder box 12. Each of the vertical members 21 has a pair of retainer walls 21*a* formed on both sides thereof and bent perpendicular to the corresponding vertical member 21 in an L-shaped manner. Each of the retainer walls 21 has an upper end formed with a guide edge 21*b* which is bent inwardly perpendicular to the corresponding retainer wall 21 also in an L-shaped manner.

Figures 7A, 7B, 7C, 7D:
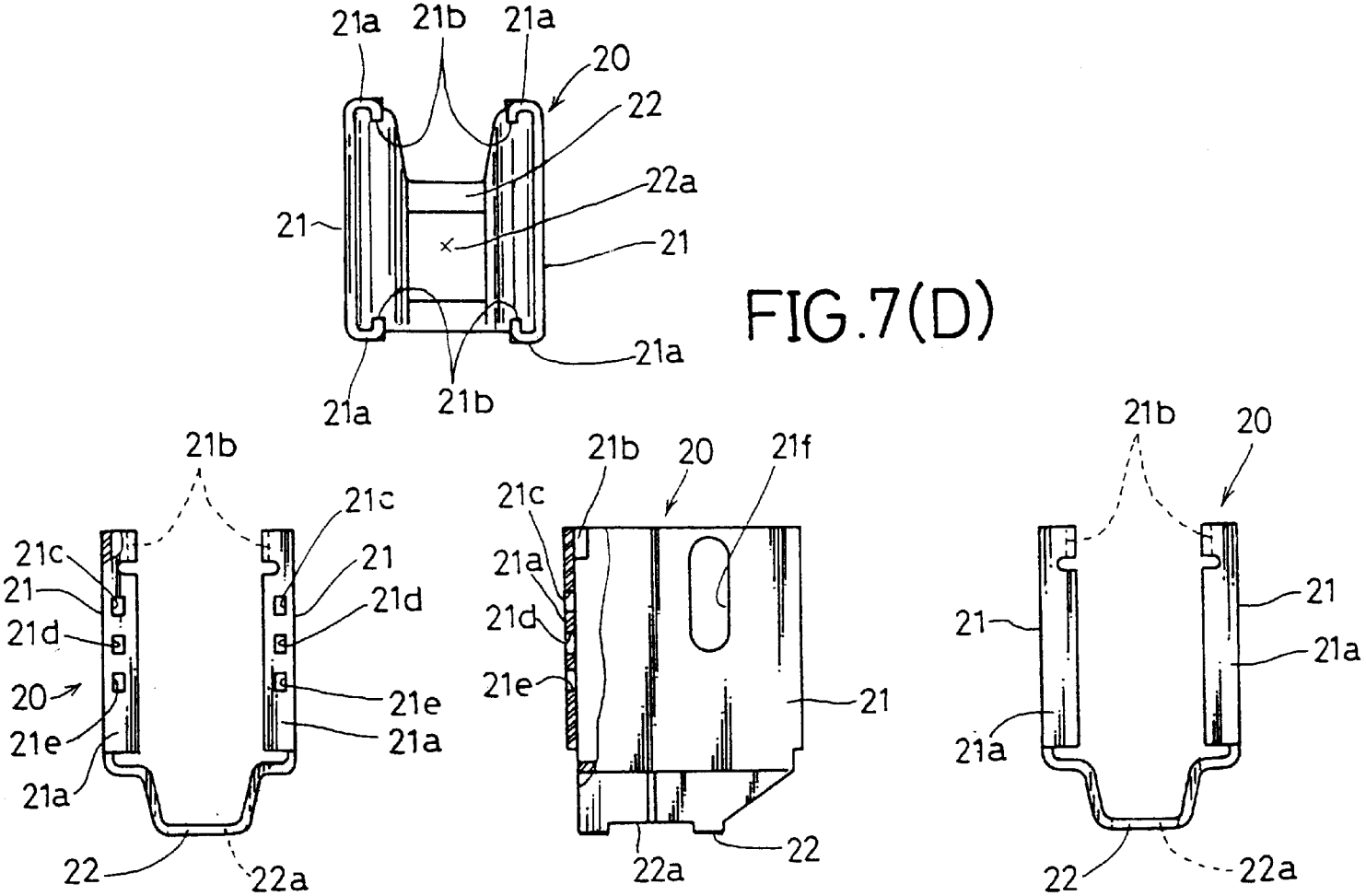
FIGS. 7(A) to 7(D) are a front view, a side view, a rear view and a plan view of the stopper base, respectively.

As shown in FIG. 7(A), each of the retainer walls 21*a* positioned on the front side has three lock holes or an upper lock hole 21*c*, a middle lock hole 21*d* and a lower lock hole 21*e* arranged in series in the vertical direction and are spaced from each other by a predetermined distance. As shown in FIG. 7(B), one of the vertical members 21 has a vertically elongated support hole 21*f* formed therein.

The transverse member 22 is adapted to be pressed on the work W during the driving operation. As shown in FIG. 7(D), a rectangular hole 22*a* is formed in the central portion of the transverse member 22. The screw SA(SB) is driven into the work S though the rectangular hole 22*a*.

Figure 6:
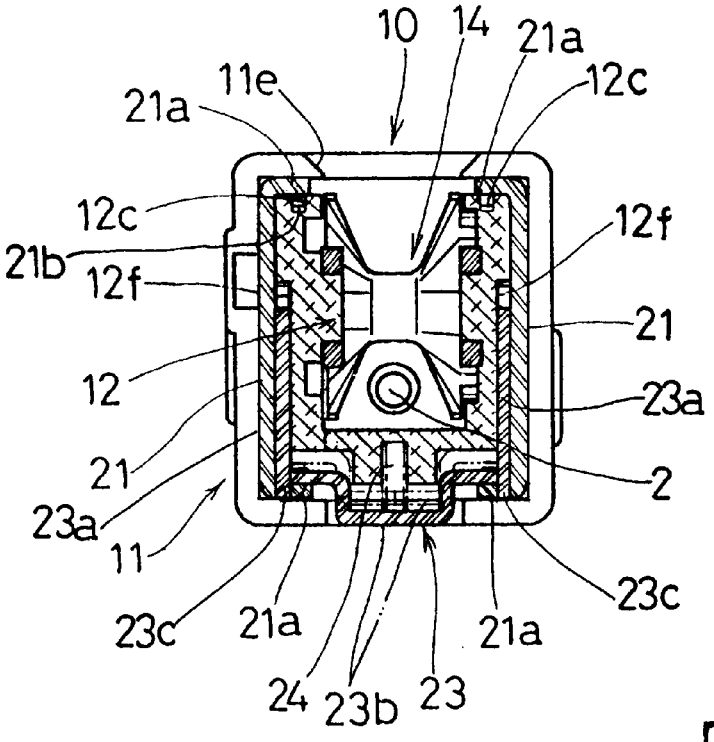
FIG. 6 is a sectional view taken along line VI—VI in FIG. 4.

On the other hand, as shown in FIGS. 3 and 6, a pair of parallel guide recesses 12*c* are formed in both front and rear surfaces (upper and lower surfaces as viewed in FIG. 6) of the feeder box 12 and are positioned adjacent their lateral edges. Each of the guide recesses 12*c* extends from the lower end of the feeder box 12 to a position substantially the same level as the support shaft 16*a* of the ratchet arm 16. The stopper base 20 is vertically slidably mounted on the feeder box 12 by inserting the guide edges 21*b* of the retainer walls 21*a* into their corresponding guide recesses 12*c* from their open lower ends. As shown in FIG. 6, the vertical members 21 and the retainer walls 21*a* slidably contact their corresponding outer surfaces of the feeder box 12 in such a manner that they partly surrounds the feeder box 12, so that the stopper base 20 in the mounted state does not show looseness in the horizontal direction.

As shown in FIGS. 2 and 4, a fixing screw 12*e* is screwed into the rear surface of the feeder box 12 through the support hole 21*f* formed in the stopper base 20, so that the stopper base 20 is permitted to be moved vertically within a movable range of a head of the fixing screw 12*e* relative to the support hole 21*f*. The fixing screw 12*e* also serves to prevent removal of the stopper base 20 from the feeder box 12.

Figure 8A:
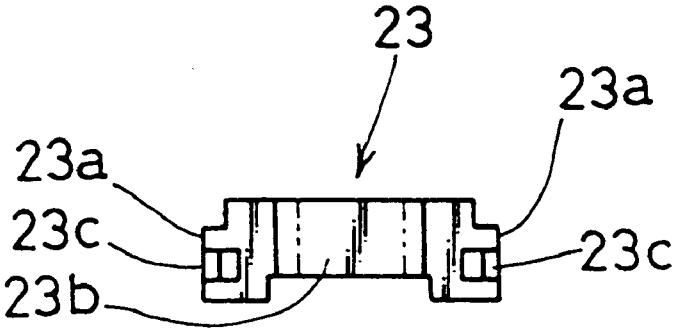
FIGS. 8(A) to 8(C) are a front view, a side view and a plan view of a lock lever, respectively.
Figure 8B:
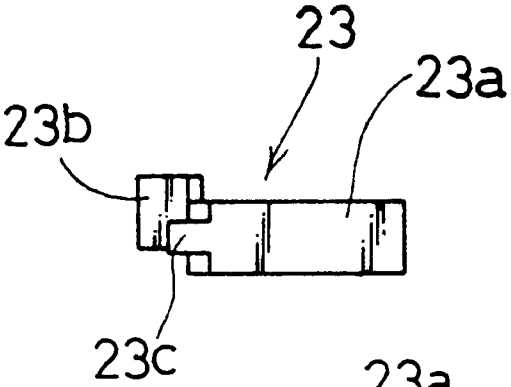
Figure 8C:
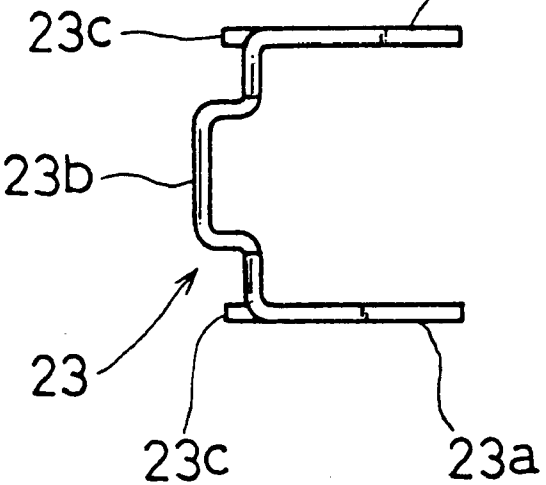

A lock lever 23 for fixing the vertical position of the stopper base 20 is shown in FIG. 6. FIGS. 8(A) to 8(C) show various views of the lock lever 23. The lock lever 23 has a substantially U-shaped configuration and includes a pair of leg members 23*a* and a transverse member 23*b* connected between the leg members 23*a*. At each of the corner portions between the leg members 23*a* and the transverse member 23*b*, a lock protrusion 23*c* protrudes forwardly from the front end of the corresponding leg member 23*a*. The lock protrusion 23*c* is formed by providing a slit in the transverse member 23*b* and bending a part of the transverse member 23*b* surrounded by the slit.

As shown in FIGS. 4 and 6, a pair of retainer recesses 12*f* are formed on both right and left surfaces of the feeder box 12 as viewed in FIG. 6 and extends horizontally from the front surface (lower surface as viewed in FIG. 6) toward the rear surface (upper surface as viewed in FIG. 6) of the feeder box 12. The leg members 23*a* of the lock lever 23 are inserted into their corresponding retainer recesses 12*f* from the open front ends of the retainer recesses 12*f*, so that the lock lever 23 is slidably movable in forward and rearward directions (vertical direction as viewed in FIG. 6) relative to the feeder box 12. As shown in FIGS. 4 and 6, in the mounting state, the leg members 23*a* are positioned between the stopper base 20 and the feeder box 12, and the lock protrusions 23*c* are oriented toward their corresponding lock holes 21*c*, 21*d* and 21*e* from the inside of the stopper base 20.

As shown in FIGS. 1 and 6, a compression spring 24 is interposed between the transverse member 23*b* of the lock lever 23 and the front surface of the feeder box 12, so that the lock lever 23 is normally biased in a direction (downward direction as viewed in FIG. 6) for inserting its lock protrusions 23*c* into the lock holes 21*c* (or 21*d*, 21*e*).

A cap 25 (not shown in FIGS. 7(A) to 7(D)) made of resilient material is mounted on the lower surface of the transverse member 22 of the stopper base 20. The cap 25 has a central portion which is fitted into the rectangular hole 22*a* of the transverse member 22 and which has protrusions 25*a* for engagement with peripheral edge of the rectangular hole 22*a*. The central portion of the cap 25 includes a rectangular hole 25*b* which is in alignment with the rectangular hole 22*a* and which is slightly smaller than the same.

With the stopper base 20 thus constructed, when the operator pushes the transverse member 23*b* of the lock lever 23 against the biasing force of the compression spring 24, the lock protrusions 23*c* are removed from the lock holes 21*c* (or 21*d*, 21*e*), so that the stopper base 20 can be moved vertically relative to the feeder box 12. The movable range of the stopper base 20 is limited by the fixing screw 12*e* having its head positioned within the support hole 21*f* as described above.

When the operator releases the transverse member 23*b* with the stopper base 20 positioned at a lowermost position indicated by chain lines in FIGS. 2 and 4, the lock lever 23 returns to bring their lock protrusions 23*c* into the lock holes 21*e*, so that the stopper base 20 is fixed in the lowermost position relative to the feeder box 12. This lowermost position is adapted when the screws SA(SB) are those having a long length.

In the same manner, when the operator releases the transverse member 23*b* with the stopper base 20 positioned at a middle position, the lock protrusions 23*c* are brought to be inserted into the lock holes 21*d*, so that the stopper base 20 is fixed in the middle position. When the operator releases the transverse member 23*b* with the stopper base 20 positioned at an uppermost position, the lock protrusions 23*c* are brought to be inserted into the lock holes 21*c*, so that the stopper base 20 is fixed in the uppermost position. The intermediate position and the uppermost position are adapted when the screws SA(SB) are those having a middle length and a short length, respectively.

As described above, the position of the stopper base 20 can be adjusted in three different positions in the vertical direction in response to the length of the screws to be driven. Since such adjustment can be performed by pushing the lock lever 23 to remove the lock protrusions 23*c* from the lock holes 21*c* (or 21*d*, 21*e*) and by releasing the lock lever 23, the operator can adjust the position of the stopper base 20 in response to the length of the screws to be driven at any time and at any place without using a special tool such as a screwdriver. Therefore, the screw feeding device 10 is excellent in operability. In addition, since the stopper base 20 is not required to be changed to that having a different size as required in the conventional device, there is no possibility that the stopper base 20 is lost.

Thus, with the conventional screw driving device disclosed in Japanese Laid-Open Patent Publication No. 6-114751, a plurality of stopper bases are prepared for different lengths of screws to be driven and can be selectively mounted on a feeder box without using any tool. However, this device involves the problem that there is some possibility that the stopper bases which are not used are lost. To this end, this publication proposes another embodiment in which a stopper base is mounted on a lower end of a screw driving device and is adjustable in its position by means of fixing screws. With this construction, the device can cope with various lengths of screws to be driven. However, this construction still involves the problem that a tool is required for tightening and loosening the fixing screws.

As described above, the conventional screw driving tools are advantageous in one aspect but are disadvantageous in other aspect. There has never been provided a screw feeding device which does not require to change a stopper base and which does not require any tool to cope with change in lengths of screws.

In contrast, with the screw feeding device 10 of this embodiment, the mounting position of the stopper base 20 can be easily changed without using any tool in response to the length of the screws to be driven, and the stopper base 20 is not required to be removed.

The mechanism for limiting the upper stroke end of the feeder box 12 or the lower stroke end of the casing 11 or the lower stroke end of the tool body 1 to be pressed downwardly will now be explained.

As shown in FIGS. 1 and 4, a stroke converting member 30 is interposed between the feeder box 12 and the casing 11. The stroke converting member 30 has a substantially L-shaped configuration and includes a vertical part 31 and a horizontal part 32 connected thereto. A conversion part 33 is formed on the horizontal part 32 and extends upwardly therefrom The upper surface of the horizontal part 32 other than the conversion part 33 serves as a first stopper surface 32*a* and the upper surface of the conversion part 33 serves as a second stopper surface 33*a*.

The vertical part 31 of the converting member 30 thus constructed is positioned between the feeder box 12 and the casing 11. The lower end of the vertical part 31 is rested on the upper end of the stopper base 20, so that the converting member 30 is vertically movable with the feeder box 12 while the vertical position of the converting member 30 is automatically changed as the vertical position of the stopper base 20 is changed among the uppermost, middle and lowermost positions.

As shown in FIG. 1, 11 and 12 or FIG. 4, when the stopper base 20 is in the lowermost position as indicated by chain lines, the converting member 30 is in its lowermost position relative to the feeder box 12. When the stopper base 20 is in the uppermost position as indicated by solid lines in FIGS. 13 to 15 or FIG. 4, the converting member 30 is in its uppermost position relative to the feeder box 12. Thus, as the position of the stopper base 20 is changed, the position of the stroke converting member 30 is changed, so that the upper stroke end of the feeder box 12 relative to the casing 11 can be changed at three different positions. In addition, the upper stroke end of the feeder box 12 relative to the casing 11 can be changed by selectively adapting the first stopper surface 32*a* or 33*b* for limiting the upper stroke end.

As shown in FIG. 1, the stopper mechanism 40 is positioned above the converting member 30 and is operable to perform two different functions. One of the functions is to convert the position of the upper stroke end of the feeder box 12 by two steps by selectively effectuating one of the first and second stopper surfaces 32*a* and 33*a* of the stroke converting member 30. The other function is to provide a fine adjustment of the upper stroke end within a predetermined range for both the first and second stopper surfaces 32*a* and 33*a*.

As shown in FIG. 1, a disk-like adjusting knob 41 is rotatably mounted on an upper portion of a right side wall of the casing 11 as viewed in FIG. 1 by means of a shaft 43 of a shifter pin 42. The shaft 43 is inserted into a central hole 41*a* formed in the adjusting knob 41. The shaft 43 is axially movable relative to the adjusting knob 41 but is not rotatable relative thereto. Thus, although the shifter pin 42 is axially movable relative to the adjusting knob 41, the shifter pin 42 is rotated together with the adjusting knob 41 when the operator rotates the adjusting knob 41.

A washer 44 is secured to an outer end of the shifter pin 42 by means of a flush bead screw 45. An annular recess 41*b* is formed in the adjusting knob 41 and has an open end confronting the washer 44. A compression spring 46 is interposed between the bottom of the annular recess 41*b* and the washer 44, so that the adjusting knob 41 is normally biased to abut on the side wall of the casing 11, while the shifter pin 42 is biased in such a direction that the outer end of the shaft 43 extends outwardly (rightwardly as viewed in FIG. 1) from the central hole 41*a* of the adjusting knob 41.

Figure 9:
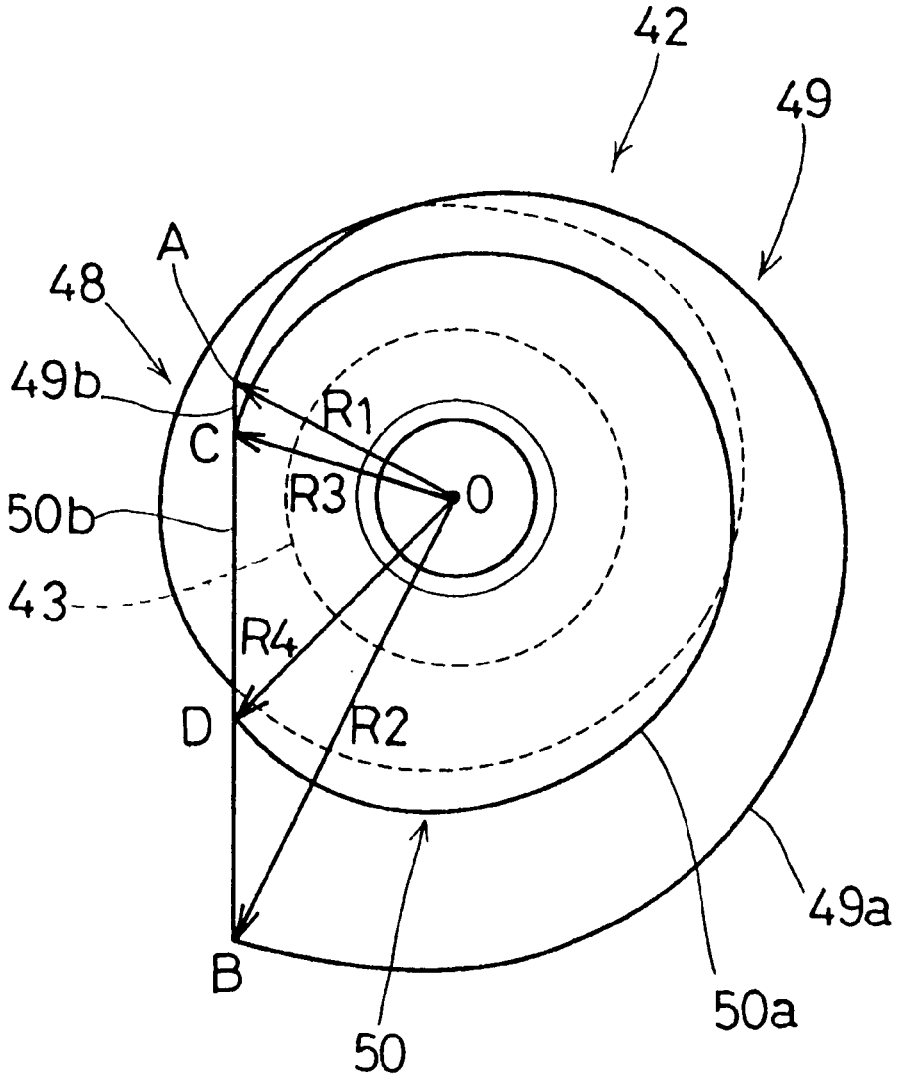
FIG. 9 is a view of a shifter pin in a direction of an arrow IX in FIG. 1 or a direction as viewed from the side of a second cam.

A projection 11*g* is formed on the side surface of the casing 11 in a position confronting the periphery of the rear surface of the adjusting knob 41 which includes a plurality of conical depressions 41*c* arranged in the circumferential direction, so that the adjusting knob 41 can be held in the adjusted position and that an excellent operation feeling (click feeling) can be given to the operator when he rotates the adjusting knob 41. A plurality of fin-like protrusions 41*d* are formed on the outer periphery of the adjusting knob 4l and serve to prevent slippage of fingers of the operator when he rotates the adjusting knob 41. The shifter pin 42 has an inner end which extends into the interior of the casing 11 through a bearing 47. The inner end of the shifter pin 42 has a flange 48, a first cam 49 and a second cam 50 which are formed integrally with the shifter pin 42. The flange 48, the first cam 49 and the second cam 50 are overlapped with each other in this sequence, and the second cam 50 is positioned at the innermost position among them. As shown in FIG. 9, the flange 48 has a circular configuration coaxial with the shaft 43 but has a greater diameter than the shaft 43. The first cam 49 has a curved surface part 49*a* and a straight surface part 49*b*. The distance from a center 0 of the shaft 43 to the curved surface part 49*a* increases gradually from a minimum distance R1 at a beginning point A to a maximum distance R2 at an end point B.

The second cam 50 also includes a curved surface part 50*a* and a straight surface part 50*b* which extends in the same plane as the straight surface part 49*b* of the first cam 49. Similar to the curved surface part 49*a* of the first cam 49, the distance from the center 0 of the shaft 43 to the curved surface part 50*a* increases gradually from a minimum distance R3 at a beginning point C to a maximum distance R4 at an end point D. The distances R1 to R4 are determined to have the relationship "R2−R1>R4−R3". Thus, the rate of change in diameter of the curved surface part 49*a* of the first cam 49 is greater than that of the curved surface part 50*a* of the second cam 50 (the curvature of the curved surface part 49*a* is gentle than that of the curved surface part 50*a*). This means that the first cam 49 provides relatively low adjusting accuracy of the upper stroke end but provides a greater adjustable range of the same while the second cam 50 provides a relatively narrow adjustable range but provides high adjusting accuracy.

The first and second stopper surfaces 32*a* and 33*a* of the stroke converting member 30 can be selectively effectuated by shifting the shifter pin 42 in the axial direction. FIGS. 1, 11 and 12 show the state where the shifter pin 42 is in a first position on the right side.

With the shifter pin 42 in the first position, the first cam 49 of the shifter pin 42 is brought to abut on the first stopper surface 32*a* of the stroke converting member 30 when the feeder box 12 is moved upwardly relative to the casing 11 as shown in FIG. 12.

Figure 10A:
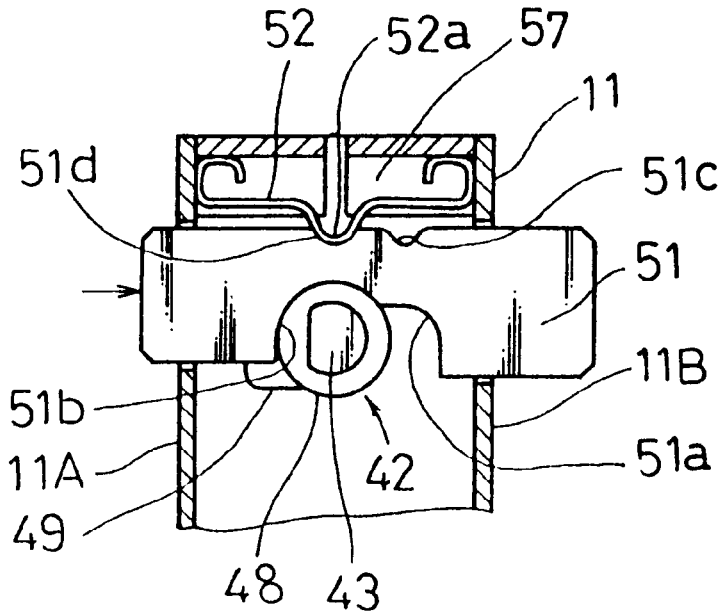
FIGS. 10(A) and 10(B) are views showing a switching plate in right and left positions for positioning the shifter pin in first and second positions, respectively.
Figure 10B:
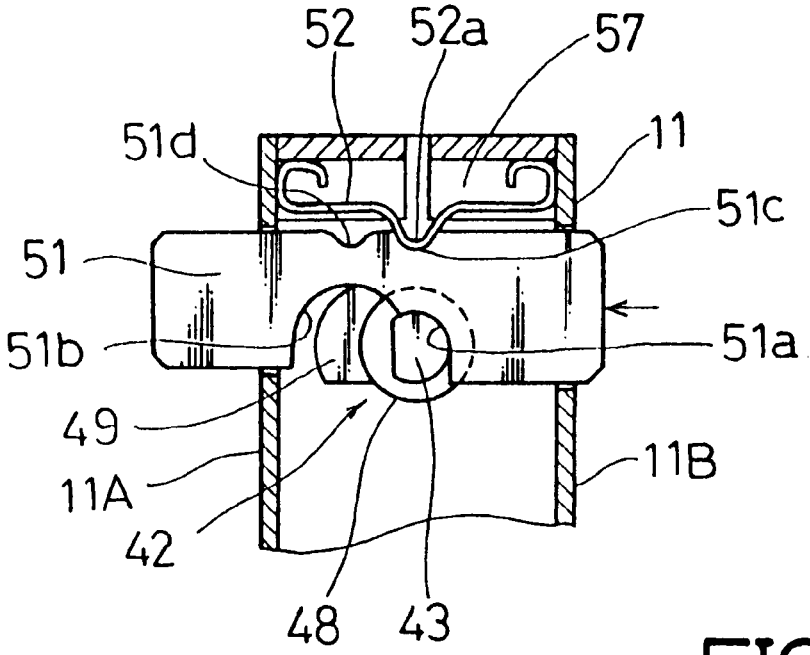

In order to shift the shifter pin 42 from the first position to the second position on the left side as shown in FIGS. 13 to 15, the operator pushes the washer 44 into the central hole 41*b* of the adjusting knob 41. With the shifter pin 42 in the second position, the second cam 50 is brought to abut on the second stopper surface 33*a* of the stroke converting member 30 as shown in FIG. 15. A switching plate 51 is provided for selectively fixing the shifter pin 42 between the first position and the second position. As shown in FIGS. 10(A) and 10(B), the switching plate 51 is slidably movably supported between the lateral wall 11A and the lateral wall 11B confronting thereto in a position above the shifter pin 42. The switching plate 51 has both ends extending outwardly from the lateral walls 11A and 11B, respectively.

As shown in FIGS. 10(A) and 10(B), a small slot 51*a* and a large slot 51*b* each having a substantially semi-circular configuration are formed in the switching plate 51 on its lower side and substantially centrally of the switching plate 51 in its longitudinal direction. The small slot 51*a* and the large slot 51*b* are formed in series with each other and are positioned on the right side and the left side, respectively, as viewed in FIGS. 10(A) and 10(B). The small slot 51*a* has a diameter to permit insertion of the shaft 43 of the shifter pin 42 while the large slot 51*b* has a diameter to permit insertion of the flange 48. The flange 48 has a diameter greater than the diameter of the shaft 48, so that the flange 48 may not pass through the small slot 51*a*. V-shaped recesses 51*c* and 51*d* are formed in the switching plate 51 on its upper side and are adapted to engage a protrusion 52*a* of a leaf spring 52. The V-shaped recesses 51*c* and 51*d* are spaced from each other by a distance equal to the distance between the centers of the small slot 51*a* and the large slot 51*b*.

The leaf spring 52 is fitted between the lateral walls 11A and 11B of the casing 11 and is fixed in position relative to the casing 11 with its protrusion 52*a* oriented downwardly toward the switching plate 51. The switching plate 51 can be held in any of right and left positions through engagement of the protrusion 52*a* with one of the V-shaped recesses 51*c* and 51*d*.

When the switching plate 51 is shifted from the left position to the right position as shown in FIG. 10(A), the large slot 51*b* is brought to confront the shifter pin 42. Since the flange 48 can pass through the large slot 51*b*, the shifter pin 42 returns to the first position by the force of the compression spring 46.

In order to shift the shifter pin 42 to the second position, the operator pushes the washer 44 into the central hole 41*b* against the biasing force of the spring 46. With the shifter pin 42 thus shifted to the second position, the operator moves the switching plate 51 from the right position to the left position as shown in FIG. 10(B), so that the small slot 51*a* is brought to confront the shifter pin 42. Since the flange 48 may not pass through the small slot 51*a*, the shifter pin 42 is prevented from returning to the first position, so that the shifter pin 42 is held in the second position. Thus, a part of the switching plate 51 about the smaller slot 51*a* is positioned between the flange 48 and the front wall of the casing 11 (see FIG. 13) to prevent the shifter pin 42 from moving from the second position to the first position. In contrast, the large slot 51*b* serves as escape means for permitting the flange 48 to pass therethrough.

When the shifter pin 42 is in the first position, the second cam 50 is positioned away from a position above the second stopper surface 33*a* of the stroke converting member 30. On the other hand, when the shifter pin 42 is in the second position, the second cam 50 is positioned above the second stopper surface 33*a*. Therefore, when the shifter pin 42 is held in the second position and when the stroke converting member 30 is moved upwardly with the feeder box 12, the second stopper surface 33*a* is brought to abut on either of the curved surface part 50*a* or the straight surface part 50*b* of the second cam 50. On the other hand, when the shifter pin 42 is returned to the first position by shifting the switching plate 51 rightwardly, the first stopper surface 32*a* is brought to abut on either the curved surface part 49*a* or the straight surface part 49*b* of the first cam 49.

As described above, the first stopper surface 32*a* is effectuated when the shifter pin 42 is in the first position, while the second stopper surface 33*a* is effectuated when the shifter pin 42 is in the second position. The first stopper surface 32*a* and the second stopper surface 33*a* are spaced from each other in the vertical direction by a distance corresponding to the height of the conversion part 33, so that the upper stroke end of the feeder box 12 or the lower stroke end of the tool body 1 can be changed by such a distance. This means that the stroke conversion function is provided.

Since the first and second cams 49 and 50 have curved surface parts 49*a* and 50*a*, respectively, each having a diameter gradually varying in the circumferential direction, the fine adjustment of the upper stroke end of the feeder box 12 can be performed in connection with both the first and second cams 49 and 50 by rotating the adjusting knob 41 at an appropriate angle. This means that the function for fine adjustment of the stroke is provided. In addition, since the rate of change in diameter of the curved surface part 49*a* of the first cam 49 is greater than that of the curved surface part 50*a* of the second cam 50, as described previously, the curved surface part 49*a* of the first cam 49 provides relatively low adjusting accuracy of the upper stroke end but provides a greater adjustable range of the same while the curved surface part 50*a* of the second cam 50 provides a relatively narrow adjustable range but provides high adjusting accuracy.

The stroke conversion operation by shifting the shifter pin 42 between the first and second positions can be performed independently or concurrently with the stroke converting operation performed by changing the position of the stopper base 20. By concurrently performing both the stroke conversion operations, the stroke can be changed within a broadest range (by six steps). FIGS. 1, 11 and 12 show the arrangement for driving the screws SA having a long length. In this arrangement, the stopper base 20 is mounted on the lowermost position, and the shifter pin 42 is shifted to the first position to effectuate the first stopper surface 32*a*, so that the stoke of the feeder box 12 has a greatest value among the six different values.

With regard to the fine adjustment by rotation of the adjusting knob 41, the stroke of the feeder box 12 may have a maximum value when the straight surface part 49*b* is adapted to abut on the first stopper surface 32*a*. The stroke becomes smaller when the operator rotates the adjusting knob 41 to bring the curved surface part 49*a* for abutment on the first stopper surface 32*a*. More specifically, the stroke of the feeder box 12 is gradually decreased as the operator rotates the adjusting knob 41 in a direction from the beginning point A to the end point B, so that the fine adjustment can be performed.

FIGS. 13 to 15 shows the arrangement for driving the screws SB having a short length. In this case, the stopper base 20 is positioned at the uppermost position, and the shifter pin 42 is shifted to the second position for effectuating the second stopper surface 33*a*, so that the stroke of the feeder box 12 has the smallest value among the six different values.

Also in this case, the stroke of the feeder box 12 becomes maximum when the straight surface part 50*b* is adapted to abut on the second stopper surface 33*a*. The stroke becomes smaller when the operator rotates the adjusting knob 41 to bring the curved surface part 50*a* for abutment on the second stopper surface 33*a*. More specifically, the stroke of the feeder box 12 is gradually decreased as the operator rotates the adjusting knob 41 in a direction from the beginning point C to the end point D, so that the fine adjustment can be performed.

With the stopper mechanism 40 of this embodiment, various types of screws (such as screws having different head configurations) can be driven into a work at their suited driving depths by shifting the shifter pin 42 between the first and second positions. In addition, such driving depths can be adjusted more accurately by rotating the adjusting knob 41.

As described above, with this embodiment, by shifting the shifter pin 42 between the first and second positions, the fine adjustment can be performed in two different modes with respect to the adjustable range and the adjusting accuracy.

Figure 16B:
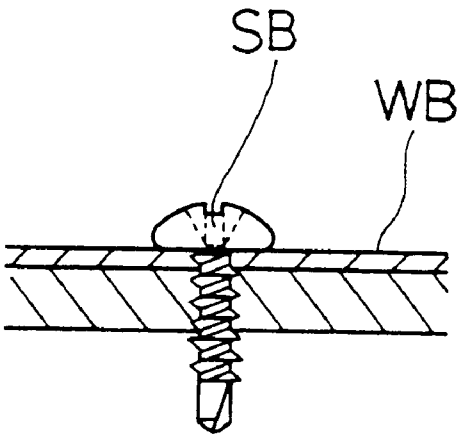
FIGS. 16(A) and 16(B) are views showing the A-type screw and the B-type screw which have been completely driven into works, respectively.
Figure 16A:
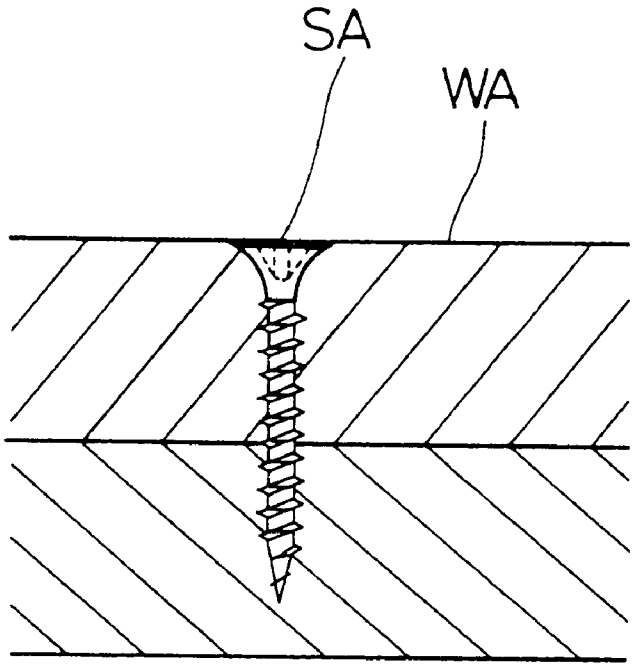

The driving depth may be varied with change in material of the work WA if a screw to be driven is the screw SA such as a drill screw having a flush head which is adapted to be driven into the work WA until the upper surface of the head of the screw SA is brought to be substantially flush with the upper surface of the work WA as shown in FIG. 16(A). Therefore, for driving the screw SA, it is desirable that the tool provides a greater adjustable range rather than a higher adjusting accuracy.

For this reason, when this kind of screw SA is to be driven, it is preferable that the shifter pin 42 is shifted to the first position to enable fine adjustment using the curved surface part 49*b* of the first cam 49, so that the adjustment can be performed with the broader adjustable range although the adjusting accuracy is not high.

On the other hand, if a screw to be driven is the screw SB such as a drill screw having a pan head which is adapted to be driven into the work WB until the lower surface of the head of the screw SB is brought to abut on the upper surface of the work WB as shown in FIG. 16(B), the driving depth must be determined highly accurately in order to cause the lower surface of the head of the screw SB to closely contact the work WVB. Thus, if the driving depth cannot be determined accurately, the problem may be caused that the screw SB is insufficiently or excessive driven into the work. Therefore, for driving the screw SB, it is desirable that the tool provides a high adjusting accuracy rather than the broader adjustable range.

For this reason, when this kind of screw SB is to be driven, it is preferable that the shifter pin 42 is shifted to the second position to permit fine adjustment using the curved surface part 50*a* of the first cam 50, so that the adjustment can be performed with high adjusting accuracy although the adjustable range is not so broad.

Thus, with the stopper mechanism 40 of this embodiment, in addition to the step-by-step adjustment of the upper stroke end and the sequential fine adjustment thereof, the fine adjustment can be performed in two different modes in response to the kind of the screw (configuration of the head of the screw) to be driven.

In contrast, with the conventional stopper mechanism disclosed in Japanese Laid-Open Patent Publication No. 5-337837, fine adjustment is performed using a single cam. Therefore, adjusting accuracy and adjustable range cannot be varied, resulting in that excessive driving or insufficient driving of the screw may be caused or that it is not possible to obtain a broader adjustable range which is sufficient for practical use.

The above embodiment may be modified in various manners.

For example, although with the stopper mechanism 40 of this embodiment, two cams 49 and 50 are provided, three or more cams can be incorporated to perform suitable fine adjustment for more various kinds of screws.

The lock holes 21*c*, 21*d* and 21*e* may be provided in the feeder box 12 in place of the stopper base 20, with the lock lever 23 provided on the stopper base 20. Although the stopper base 20 can be positioned at three different positions, it may be constructed to be positioned at two or four or more positions.

Although the stroke converting member 30 includes two stopper surfaces 32*a* and 33*a*, three or more stopper surfaces may be provided.

In addition, the stroke converting member 30 may be mounted on the casing 11 so as to be moved in response to change in position of the stopper base 20, with the stopper mechanism 40 provided on the feeder box 12.

Further, although in the above embodiment, the ratchet arm 16 and the intermediate gear 15 is disengaged from each other by pushing the releasing button, this embodiment may be modified such that the ratchet arm 16 and the intermediate gear 15 are disengaged from each other by pulling or pivoting a releasing member corresponding to the releasing button 18.

A second embodiment of the present invention will now be explained with reference to FIGS. 17 to 24(C).

Figure 17:
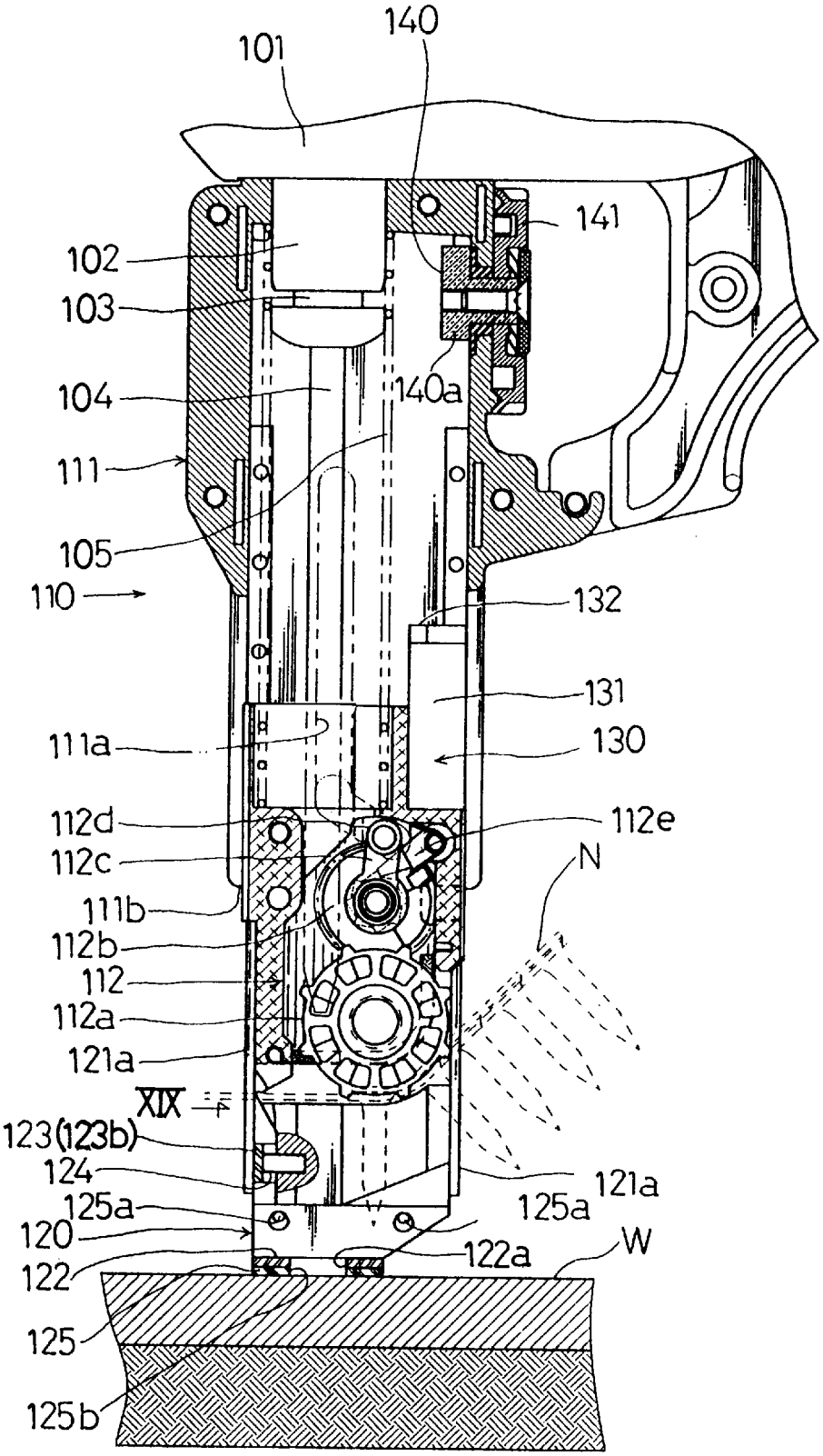
FIG. 17 is a view of the interior of a screw feeding device according to a second embodiment of the present invention and showing the state where the screw feeding device is in an inoperative position and where a feeder box is in its lowermost position relative to a casing.

FIG. 17 shows a screw feeding device 110 mounted on a tool body 101 of a continuous screw driving tool.

As with the first embodiment, the screw feeding device 110 includes a casing 111 having a substantially rectangular configuration in section. The casing 111 has an upper portion secured to a bearing 102 for a spindle 103 of the tool body 101, so that the screw feeding device 110 is fixed in position relative to the tool body 101. The spindle 103 extends downwardly through the bearing 102 and has a driver bit 104 mounted on its lower end.

A feeder box 112 is vertically movably inserted into the casing 111. A compression spring 105 is interposed between the upper portion of the feeder box 112 and a lower surface of an upper plate of the feeder box 112, so that the feeder box 112 is normally biased downwardly by the spring 105. The feeder box 112 has a through hole through which the spindle 103 extends downwardly.

A ratchet wheel 112*a* has a plurality of feeding claws formed on its outer periphery. The feeding claws are in engagement with engaging holes formed in a screw carrying belt N, so that the screw carrying belt N is moved by a distance corresponding to one pitch of the screws carried on the screw carrying belt N as the ratchet wheel 112*a* is rotated by a predetermined angle.

The ratchet wheel 112*a* is rotated by the predetermined angle as the feeder box 112 is moved upwardly relative to the casing 111 by a predetermined stroke in connection with the screw driving operation of the tool body 101. Thus, the ratchet wheel 112*a* is in engagement with an intermediate gear 112*b* which is also in engagement with a ratchet arm 112*c* by means of a one-way clutch as described in connection with the first embodiment. The ratchet arm 112*c* has one end having a guide roller 112*d* mounted thereon. The guide roller 112*d* is in engagement with a guide recess 11*a* formed in one lateral wall of the casing 111, so that the guide roller 112*d* is moved along a slant portion of the guide recess 111*a* and that the ratchet arm 112*c* is pivoted by the predetermined angle in a counterclockwise direction as viewed in FIG. 17.

As the ratchet arm 112*c* is pivoted, the intermediate gear 112*b* which is in engagement with the ratchet arm 112*c* is rotated, so that the ratchet wheel 112*a* is rotated in the counterclockwise direction by the predetermined angle. After the ratchet wheel 112*a* has been rotated by the predetermined angle, the guide roller 112*d* enters a straight vertical portion (parallel to the moving direction of the feeder box 112) of the guide slot 111*a*, so that the ratchet wheel 112*a* as well as the intermediate gear 112*b* and the ratchet arm 112*c* may not rotate further.

Figure 18:
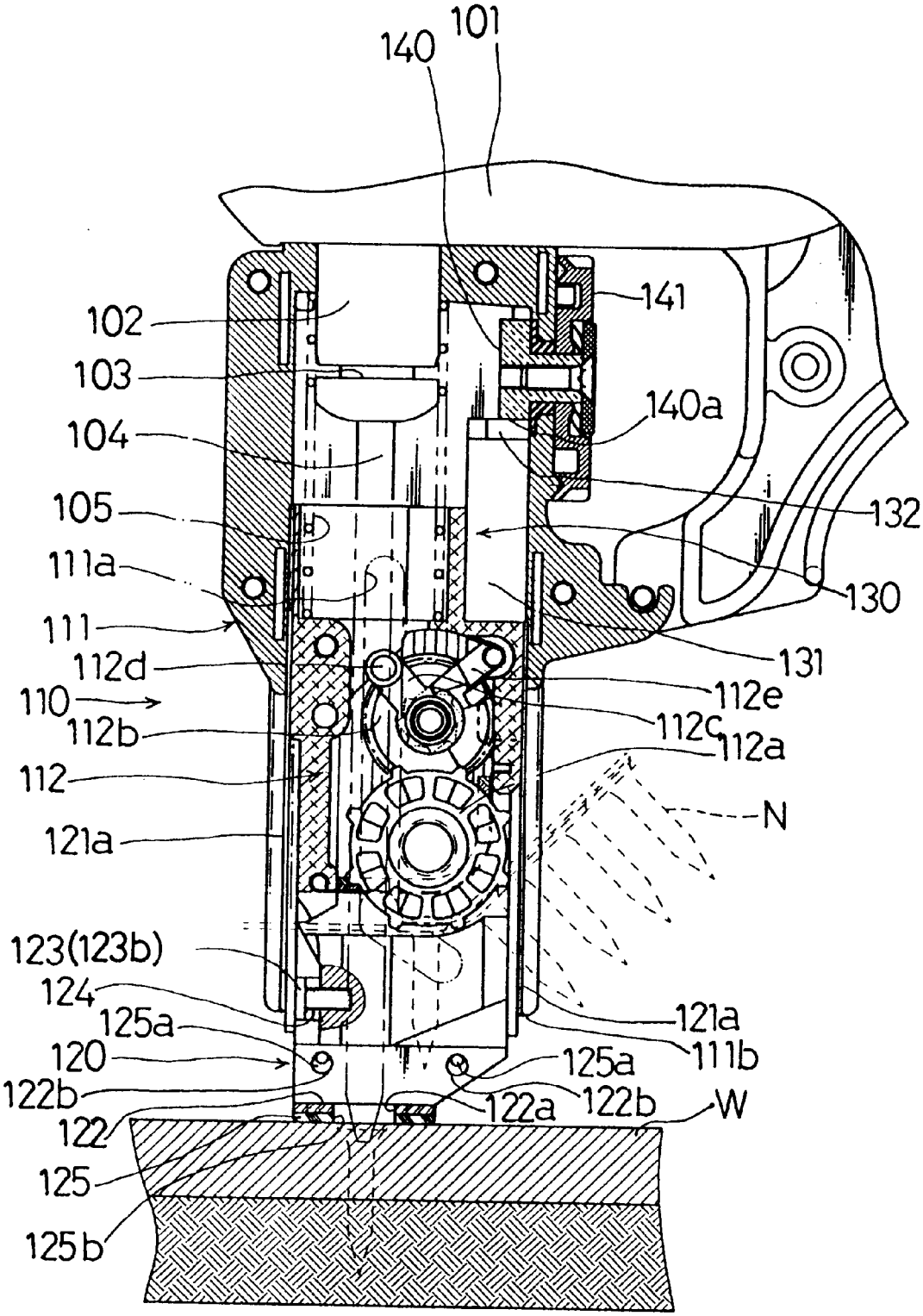
FIG. 18 is a view similar to FIG. 17 but showing the state where the screw driving operation has been completed and where the feeder box in its uppermost position.

FIG. 18 shows the state where the tool body 101 has been pressed downwardly to reach its lowermost position or where the operation for driving the screw has been completed. In this state, the feeder box 112 is in its uppermost position relative to the casing 111. When the operator releases the pressing force applied to the tool body 101, the feeder box 112 is moved downwardly relative to the casing 111, so that the ratchet arm 112*c* is rotated in the clockwise direction by the movement of the guide roller 112*d* along the slant portion of the guide recess 111*a*. However, because of the provision of the one-way clutch, the pivotal movement of the ratchet arm 112*c* may not be transmitted to the intermediate gear 112*b* and to the ratchet wheel 112*a*. Therefore, the screw carrying belt N may not be moved in a direction opposite to its feeding direction. A detent claw 112*e* is provided for preventing rotation of the intermediate gear 112*b* in the direction opposite to the feeding direction.

A stopper base 120 is mounted on the lower portion of the feeder box 112 and is adapted for abutment on a work W.

Figure 24B:
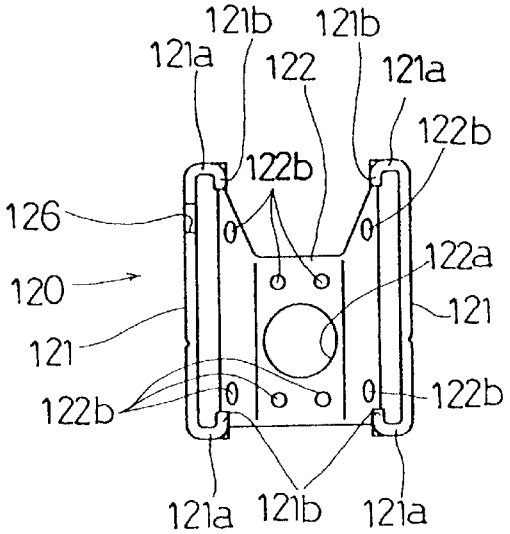
FIGS. 24(A) to 24(C) are a side view, a front view and a plan view of the stopper base, respectively.

The stopper base 120 has a substantially U-shaped configuration including a pair of vertical members 121 and a transverse member 122 connected between the lower ends of the vertical members 121. The stopper base 120 is mounted on the feeder box 112 such that the stopper base 120 extends between both bifurcated lower portions of the feeder box 112. Each of the vertical members 121 has a pair of retainer walls 121*a* formed on both sides thereof and bent perpendicular to the corresponding vertical member 121 in an L-shaped manner. Each of the retainer walls 121*a* has an upper end formed with a guide edge 121*b* which is bent inwardly perpendicular to the corresponding retainer wall 121*a* also in an L-shaped manner. As shown in FIG. 24(C), one of the retainer walls 121*a* positioned on the front side has five lock holes 121*c* which are arranged in series in the vertical direction and which are spaced from each other by a predetermined distance.

The transverse member 122 is adapted to be pressed on the work during the driving operation. As shown in FIG. 24(B), an insertion hole 122*a* is formed in the central portion of the transverse member 122. The screw is driven into the work W through the insertion hole 122*a*.

Figure 19:
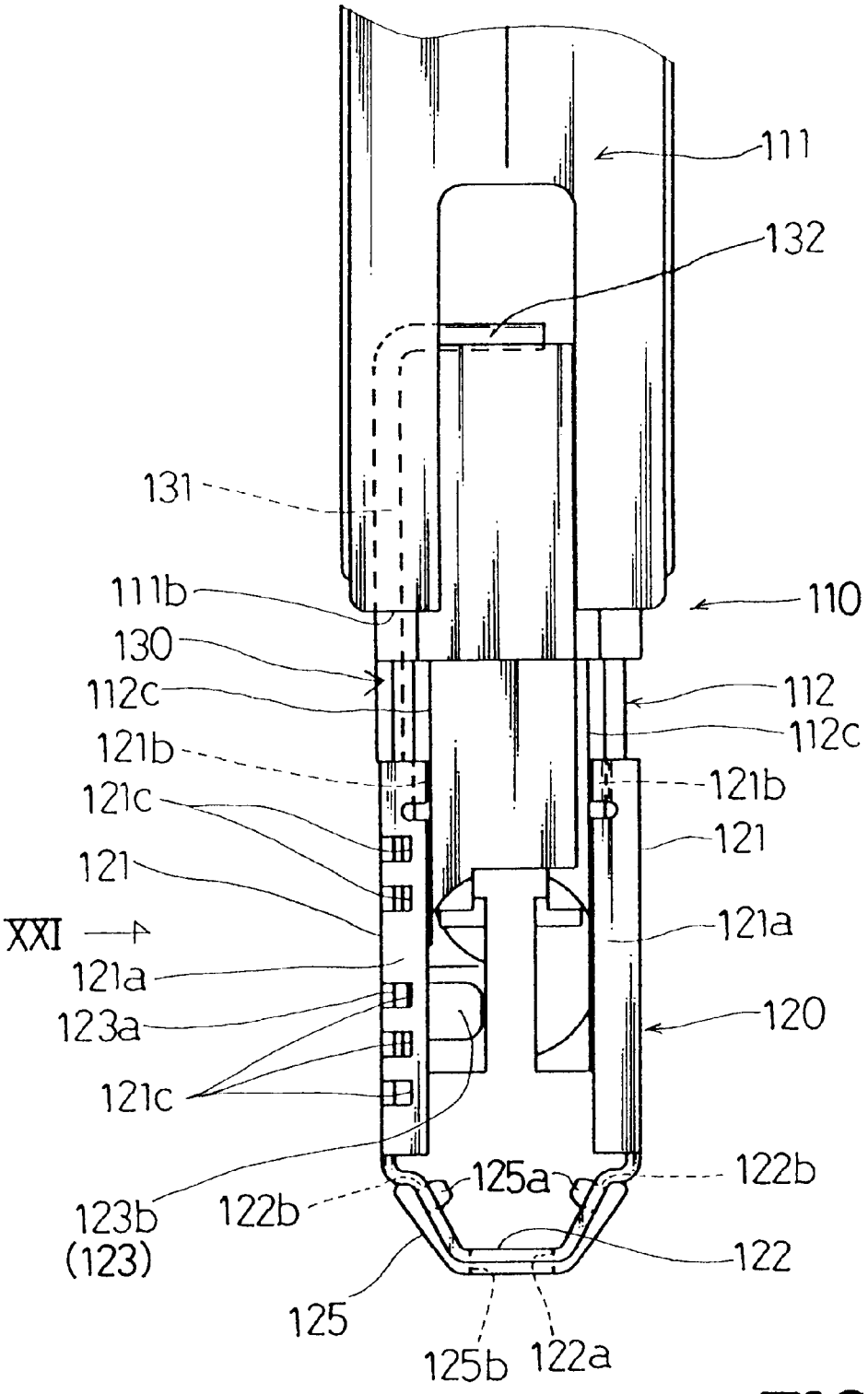
FIG. 19 is a front view of the screw feeding device as viewed in a direction of arrow XIX in FIG. 17 and showing the state where a stopper base is fixed in position at a third step (a position for driving a screw having the length of 40 mm)
Figure 20:
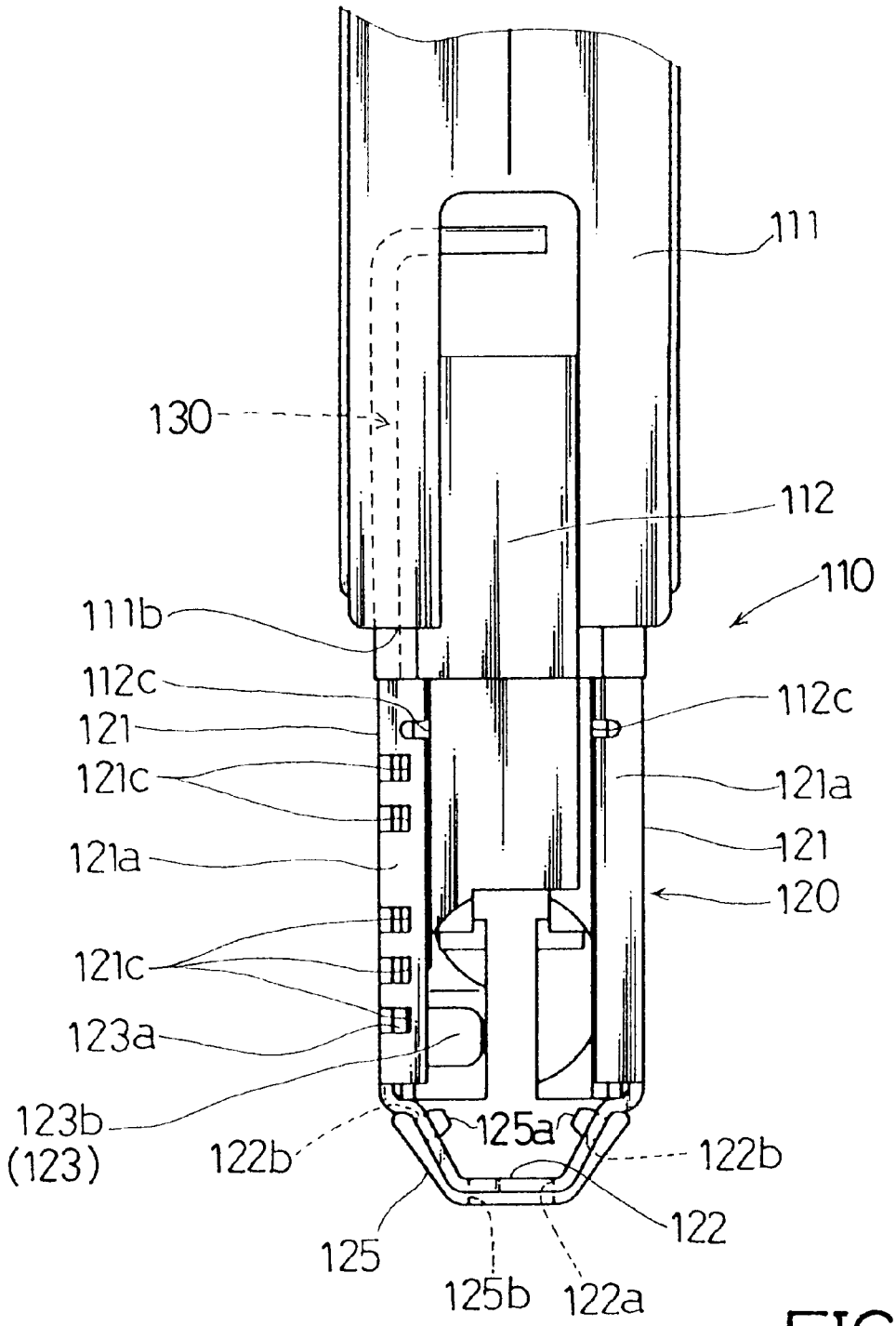
FIG. 20 is a view similar to FIG. 19 but showing the state where the stopper base is fixed in position at a first step (a position for driving a screw having the length of 25 mm or 28 mm)
Figure 23A:
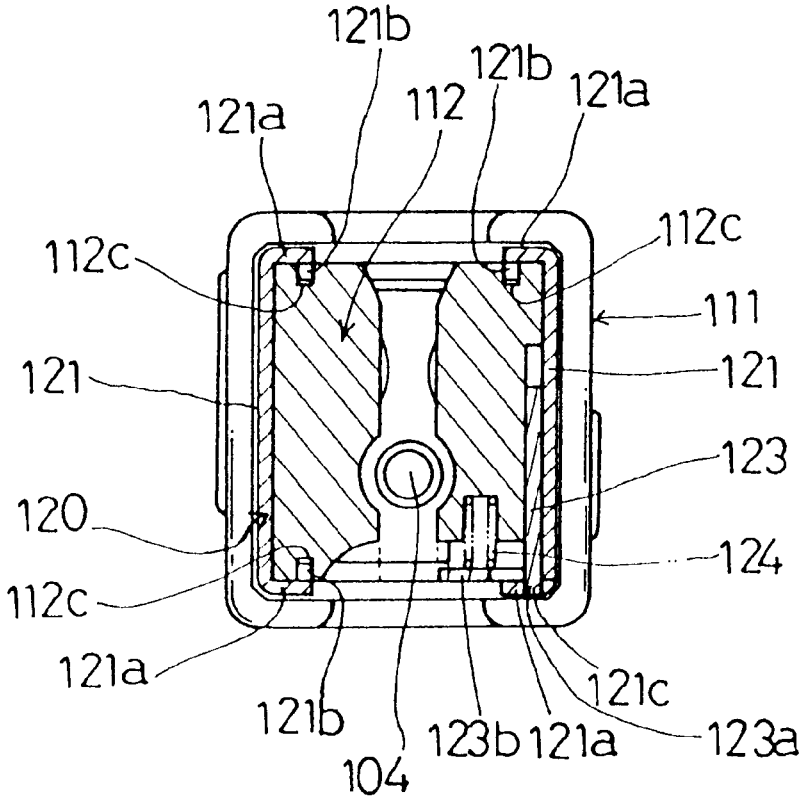
FIG. 23(A) is a sectional view taken along line XXIII—XXIII in FIG. 21 and showing the state where a lock lever is in an inoperative position.
Figure 23B:
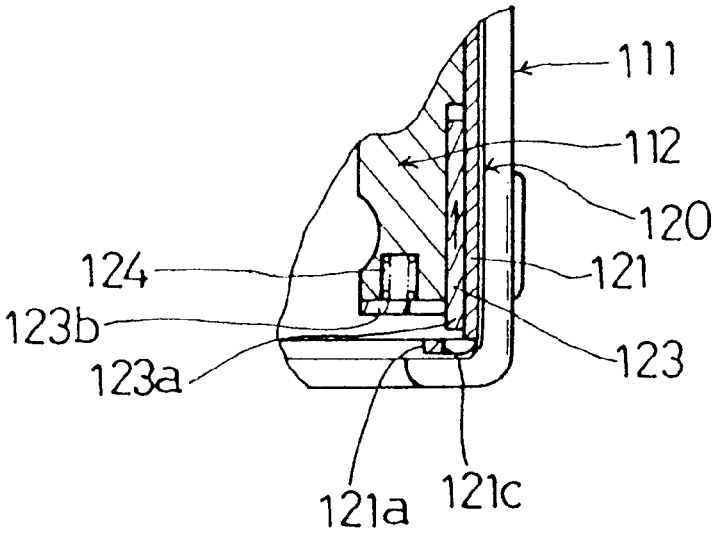
FIG. 23(B) is a partial view of FIG. 23(A) and showing the state where the lock lever has been removed from the lock hole by the pushing operation of the lock lever.

On the other hand, as shown in FIGS. 19 and 23(A), a pair of parallel guide recesses 112*c* are formed on both front and rear surfaces of the feeder box 112 and are positioned adjacent their lateral edges. Each of the guide recesses 112*c* extends from the lower end of the feeder box 112 to a position substantially the same level as the ratchet arm 116. The stopper base 120 is vertically slidably mounted on the feeder box 112 by inserting the guide edges 121*b* of the retainer walls 121*a* into their corresponding guide recesses 112*c* from their open lower ends. The vertical members 121 and the retainer walls 121*a* slidably contact their corresponding outer surfaces of the feeder box 112 in such a manner that they partly surrounds the feeder box 112, so that the stopper base 120 in the mounted state does not show looseness in the horizontal direction.

A lock lever 123 is provided for fixing the vertical position of the stopper base 120 relative to the feeder box 112 by five steps or at five different positions. The lock lever 123 has a substantially L-shaped configuration and includes a lock protrusion 123*a*. The lock lever 123 is biased by a compression spring 124 in such a direction that the lock protrusion 123 is moved toward the lock holes 121*c*. When the operator pushes an operation part 123*b* of the lock lever 123 with his fingers against the biasing force of the compression spring 124 to remove the lock protrusion 123*a* from the lock hole 121*c* as inserted, the vertical position of the stopper base 120 can be changed to a desired position. Thus, when the operator releases his fingers with the stopper base 120 positioned to confront the other one of the lock holes 121*c*, the lock protrusion 123*a* is brought to be inserted into that lock hole 121*c*.

A cap 125 made of resilient rubber is attached to the lower surface of the transverse member 122 of the stopper base 120. The cap 125 has an upper surface formed with a plurality of engaging protrusions 125*a* which are forcibly fitted within engaging holes 122*b* formed in the transverse member 122 through the resilient deformation of the engaging protrusions 125*a*, so that the cap 125 is detachable from the stopper base 120. The central portion of the cap 125 includes an insertion hole 125*b* which is in alignment with the insertion hole 122*a* of the transverse member 122.

Figure 21:
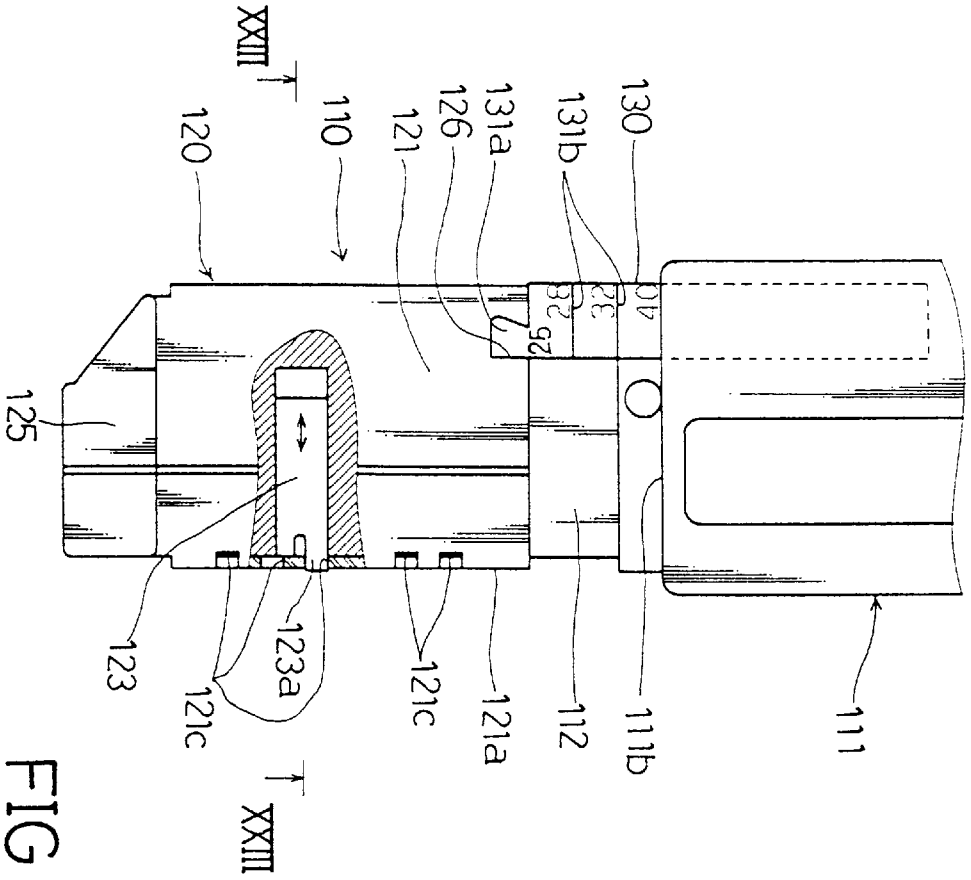
FIG. 21 is a view of the screw feeding device as viewed in a direction of arrow XXI in FIG. 19.
Figure 24A:
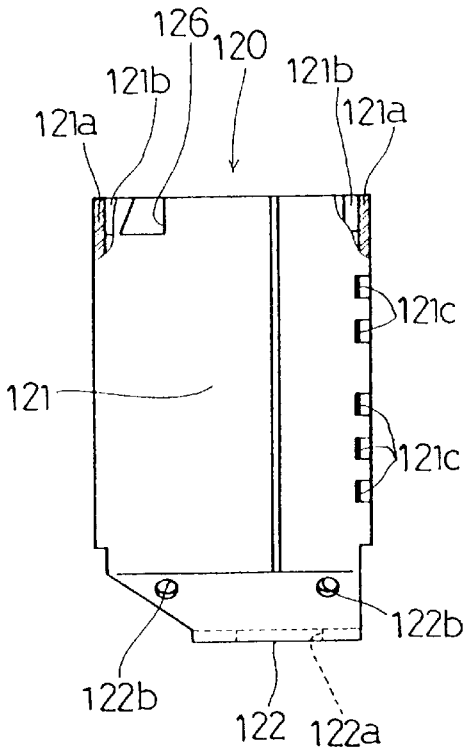
Figure 24C:
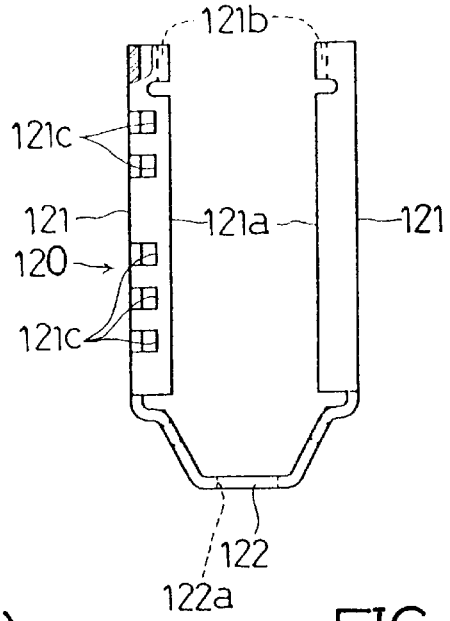

As shown in FIGS. 21 and 24(A), a connecting recess 126 is formed in the upper end of the stopper base 120 and has an open upper part or inlet part. The connecting recess 126 is configured such that its width in the horizontal direction at the bottom part is greater than that at its inlet part. The connecting recess 126 is adapted for connection to a stroke converting member 130 as will be explained later.

As shown in FIGS. 17 to 19, the stroke converting member 130 is provided between the feeder box 112 and the casing 111 and serves to vary the upper stroke end of the feeder box 112, and the function of the stroke converting member 130 is basically the same as the stroke converting member 30 of the first embodiment.

Figure 22:
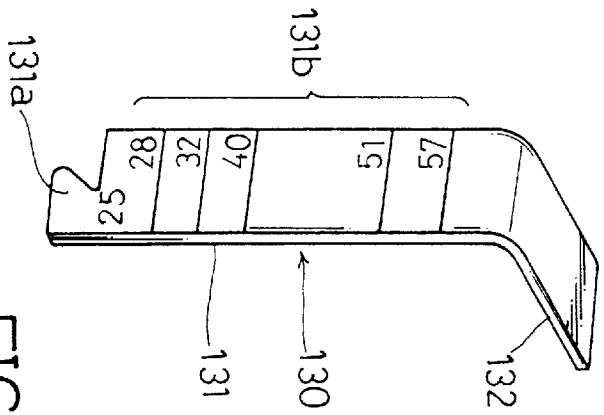
FIG. 22 is a perspective view of a display member for suitable screw lengths or a stroke converting member.

As shown in FIG. 22, the converting member 130 has a substantially L-shaped configuration and includes a vertical part 131 and a horizontal part 132 connected thereto. The vertical part 131 is put between the feeder box 112 and the casing 11, so that the vertical part 131 may not be moved in the horizontal direction. A connecting part 131*a* is formed on the lower end of the vertical part 131 and has a configuration corresponding to the connecting recess 126 of the stopper base 120. With the connecting part 131 engaged with the connecting recess 126, the stroke converting member 130 is moved vertically as the stopper base 120 is moved vertically relative to the feeder box 112 for varying the position of the stopper base 120 among the five positions. Here, the stroke converting member 130 can be easily removed from the stopper base 120 by moving the stroke converting member 130 to be displaced from the stopper base 120 in the direction of thickness of the vertical part 131.

Scale marks 131*b* with numerals representing the lengths of the screw are affixed to an outer surface of the vertical part 131. With the provision of the scale marks 131*b*, in addition to the function for converting the stroke of the feeder box 112, the stroke converting member 130 of this embodiment serves as a screw length display member for displaying the length of a screw which is suitable to be driven. The lower end of the casing 111 serves as a cursor 111*a* for indicating any of the scale marks 131*b* corresponding to the suitable screw length.

In this embodiment, the numerals of the scale marks 131*b* represent five different lengths or 25 mm (28 mm), 32 mm, 40 mm, 51 mm and 57 mm. With the stopper base 120 held in its uppermost position relative to the feeder box 112 on the condition that the feeder box 112 is in its lower stroke end or the condition that the tool body 101 is not pressed downwardly, when the lock protrusion 123 of the lock lever 123 is inserted into one of the lock holes 121*c* in the lowermost position, the stroke converting member 130 is in its uppermost position relative to the feeder box 112. In this position, the cursor 111*a* points to the scale mark 131*b* corresponding to the screw length of 25 mm or 28 mm.

When the stopper base 120 is lowered by one step and when the lock protrusion 123*a* is inserted into the lock hole 121*c* which is a second one in the upward direction, the cursor 111*a* points to the scale mark 131*b* corresponding to the screw length of 32 mm. When the stopper base 120 is further lowered by one step and when the lock protrusion 123*a* is inserted into the lock hole 121*c* which is a third one in the upward direction, the cursor 111*a* points to the scale mark 131*b* corresponding to the screw length of 40 mm. The stopper base 120 set in this third step position is shown in FIGS. 19 and 21.

When the stopper base 120 is further lowered from the third step position and when the lock protrusion 123*a* is inserted into the lock holes 121*c* which are a fourth and a fifth one, the cursor 111*a* points the scale marks 131*b* corresponding to the screw length of 51 mm and 57 mm, respectively.

Since the screw length suited to the position of stopper base 120 relative to the casing 111 is thus indicated by the lower end or the cursor 111*a* of the casing 111, the operator can determine the position of the stopper base 120 by visually referencing to the screw length indicated by the cursor 111*a* when the screw to be driven is changed to one having a different length.

When the position of the stroke converting member 130 is varied with change in position of the stopper base 120 by five steps, the upper stroke end of the feeder box 12 may be changed by five steps.

As shown in FIGS. 17 and 18, a stopper pin 140 is mounted on the upper portion of the casing 111 and protrudes into the interior of the casing 111. As the feeder box 112 is moved upwardly relative to the casing 111 by the downward pressing operation of the tool body 101, the horizontal part 132 of the stroke converting member 130 is brought to abut on a peripheral surface 140*a* of the stopper pin 140 as shown in FIG. 18, so that the upper stroke end of the feeder box 112 can be limited. Therefore, the stroke of the feeder box 112 can be varied by five steps according to change in position of the stroke converting member 130 by five step.

The stopper pin 140 has an adjusting knob 141 and is rotatable about its axis by the operation of the adjusting knob 141. The peripheral surface 140*a* has a circular configuration but has a center which is displaced from the rotational axis of the stopper pin 140, so that fine adjustment of the upper stroke end or the driving depth of the screw can be performed by the rotational operation of the adjusting knob 141.

As described above, with this embodiment, in addition to the function to permit change in fixing position of the stopper base 120 without using any tool as with the first embodiment, the screw lengths suitable to various adjusted positions of the stopper base 120 are directly indicated by the scale marks 131*b*. Therefore, the operator can adjust the position of the stopper base 120 with visually recognizing the suitable screw length by the scale mark 131*b* pointed by the cursor 111*b*.

The screw feeding device 110 of this embodiment incorporating the scale marks 131*b* and the cursor 111*b* is excellent in operability since the relationship between the positions of the stopper base 120 and the screw lengths suitable thereto can be readily recognized by the operator.

In addition, with this embodiment, since the stroke converting member 130 and the casing 111 themselves are used for showing the suitable screw lengths, it is not necessary to incorporate additional members for this purpose. Therefore, this embodiment is excellent in a viewpoint of the number of parts and manufacturing costs.

Further, the mounting operation of the screw length display member or stroke converting member 130 can be easily mounted on and removed from the stopper base 120 since the stroke converting member 130 is mounted on the stopper base 120 by engaging the connecting part 131*a* with the engaging recess 126 of the stopper base 120 in the direction of thickness of the vertical part 131. Therefore, this embodiment is excellent in its assembling and handling. Thus, in order to vary the scale marks 131*b* or in order to vary the adjustable upper stroke end of the feeder box 112, it is only necessary to change the stroke converting member 130 to another one, while the stopper base 120 can be used as it is.

The above embodiment may be modified in various manners. For example, although the position of the stopper base 120 is adjustable in five steps, such a position may be adjusted in different number of steps other than five. In such a case, the number of the scale marks 131*b* may be decreased or increased in response to the number of the adjustable steps.

In addition, the scale marks 131*b* and the cursor 111*b* may be incorporated to a screw feeding device having a stopper base which can be fixed in position at any positions within a predetermined range.

Further, the stroke adjusting member 130 may be formed integrally with the stopper base 120.

Although in the above embodiment, the cursor 111*b* is constituted by the lower end of the casing 111, such a cursor may be constituted by a window which is formed in the casing 111 and through which the operator can recognize the scale marks.

Finally, a member separate from the stroke converting member 130 may be incorporated as a screw length display member.

While the invention has been described with reference to preferred embodiments thereof, it is to be understood that modifications or variations may be easily made without departing from the spirit of this invention which is defined by the appended claims.

What is claimed is:

1. A screw feeding device in a continuous screw driving tool, comprising:

a casing mounted on a tool body of the continuous screw driving tool;

a feeder box reciprocally movable within said casing, so that a screw carrying belt is fed by one pitch, the distance corresponding to two adjacent screws carried on the belt, as said feeder box is moved by one stroke;

a stopper base mounted on said feeder box;

mounting means for mounting said stopper base on said feeder box, so that said stopper base can be changed in its position relative to said feeder box;

the mounting means including a plurality of lock holes formed on one of said stopper base and said feeder box and spaced from each other by a predetermined distance in a driving direction of a screw;

a lock member having a lock protrusion engageable with any of said lock holes and held in position in said screw driving direction relative to the other of said stopper base and said feeder box; said lock member being movable in a direction to engage any of said lock holes and in a direction opposite thereto, said mounting means further including biasing means for normally biasing said lock member in said engaging direction; said lock holes being formed in the stopper base, said feeder box including a recess for receiving the lock member, the lock member being slidably movable within said recess in a direction perpendicular to said driving direction of the screw; the stopper base being slidably movable along an outer wall of the feeder box; a wall part having the lock holes formed therein; said recess formed on the feeder box extending in a direction perpendicular to a longitudinal direction of said wall part; and said lock protrusion of the lock member being positioned to confront the wall part.

2. The screw feeding device as defined in claim 1 wherein said feeder box has a substantially rectangular configuration in section including a first pair of confronting side walls, a second pair of confronting side walls; said stopper base including a pair of vertical members slidably movable along said first pair of confronting side walls of said feeder box, and each of said vertical walls including a pair of retainer walls formed on both sides of said vertical walls bent substantially perpendicular to a corresponding vertical wall along a corresponding corner portion of said feeder box, at least one of said retainer walls comprising said wall part having the lock holes.

3. The screw feeding device as defined in claim 2 wherein said lock member includes a part positioned between said wall part and one of said second pair of confronting outer walls of said feeder box, said part extending outwardly beyond said wall part and serving as an operation part for operation by an operator.

4. The screw feeding device as defined in claim 2 wherein said recess is formed in said at least one of said first pair of confronting side walls of said feeder box, and wherein said lock member has a horizontal part received within said recess and positioned between said at least on of said first pair of confronting side walls and said vertical member of said stopper base facing thereto.

5. The screw feeding device as defined in claim 3 wherein said lock member has a horizontal part and a transverse part, said horizontal part being slidably received within said recess and having one end formed with said lock protrusion, said transverse part being bent substantially perpendicular to said horizontal part and extending along corresponding one of said second pair of confronting side walls, and said transverse part comprising the part having said operation part.

6. The screw feeding device as defined in claim 5 wherein two of said retainer walls of said stopper base positioned on the side of one of said second pair of said side walls of said feeder box comprise said wall parts having said lock holes, and wherein said lock member includes a pair of said horizontal parts and one transverse part connecting said horizontal parts to each other.

7. The screw feeding device as defined claim 5 wherein said biasing means is a spring interposed between said transverse member and one of said second pair of said side walls wall said feeder box.

8. A screw feeding device in a continuous screw driving tool, comprising:

a casing mounted on a tool body of the continuous screw driving tool;

a feeder box reciprocally movable within said casing, so that a screw carrying belt is fed by one pitch, the distance corresponding to two adjacent screws carried on the belt, as said feeder box is moved by one stroke;

a stopper base mounted on said feeder box;

mounting means for mounting said stopper base on said feeder box, so that said stopper base can be changed in its position relative to said feeder box;

the mounting means including a plurality of lock holes formed on one of said stopper base and said feeder box and spaced from each other by a predetermined distance in a driving direction of a screw;

a lock member having a lock protrusion engageable with any of said lock holes and held in position in said screw driving direction relative to the other of said stopper base and said feeder box; display means for displaying screw lengths suited to adjustable positions of said stopper base relative to said feeder box, said display means being operable to vary the displayed screw length in response to change in position of said stopper base, and said display means including a display member and a cursor, said display member being movable with said stopper base relative to said feeder box and having scale marks with numerals showing screw lengths; said cursor being formed by a part of said casing.

9. The screw feeding device as defined in claim 8 wherein said display member is positioned within said casing and extends downwardly from a lower end of said casing along an inner wall of said casing, and said lower end of the casing comprising said cursor.

10. The screw feeding device as defined in claim 8 wherein said display member serves to limit an upper stroke end of said feeder box relative to the casing.

11. The screw feeding device as defined in claim 10 wherein said display member is detachably mounted on the feeder box.

12. A screw driving device in a continuous screw driving tool, comprising:

a casing mounted on a tool body of the continuous screw driving tool;

a feeder box reciprocally movable within said casing, so that a screwing belt is fed by a distance corresponding to a distance between two adjacent screws disposed thereon as said feeder box is moved by one stroke;

a stopper base mounted on said feeder box; and means for mounting said stopper base on said feeder box, so that the position of said stopper base can be changed relative to said feeder box;

said mounting means including:

means for permitting said stopper base to move relative to said feeder box only in a screw driving direction or a direction opposite thereto;

a plurality of lock holes formed in one of said stopper base and said feeder box and spaced from each other by a predetermined distance in the screw driving direction or the direction opposite thereto; and a lock member having a lock protrusion selectively moveable and engageable with any one of said lock holes, said lock member being fixed in position relative to the other of said stopper base and said feeder box;

said lock member further including an operating portion that is operable by an operator for shifting said lock member from a first position to a second position or vice versa, said lock protrusion being engageable with said lock holes when said lock member is in said first position, and said lock protrusion being disengaged from said lock holes when said lock member is in said second position.

13. The screw driving device as defined in claim 12, further including biasing means for normally biasing said lock member toward said first position.

14. The screw driving device as defined in claim 13 wherein said lock holes are formed in said stopper base, and wherein said feeder box includes a recess for receiving said lock member, said lock member being slidably movable within said recess in a direction perpendicular to said screw driving direction.

15. The screw driving device as defined in claim 12 wherein said feeder box has an outer surface that is polygonal in section, and wherein said means for permitting said stopper base to move relative to said feeder box includes an inner wall of said stopper base that surrounds the outer surface of said feeder box for slidably receiving said feeder box.

* * * * *